US008353683B2

(12) United States Patent
Miyazaki et al.

(10) Patent No.: US 8,353,683 B2
(45) Date of Patent: Jan. 15, 2013

(54) MICROPUMP, PUMP MODULE, AND DRIVE MODULE

(75) Inventors: Hajime Miyazaki, Matsumoto (JP); Mamoru Miyasaka, Shiojiri (JP); Kazuo Kawasumi, Chino (JP)

(73) Assignee: Seiko Epson Corporation (JP)

( * ) Notice: Subject to any disclaimer, the term of this patent is extended or adjusted under 35 U.S.C. 154(b) by 904 days.

(21) Appl. No.: 12/125,139

(22) Filed: May 22, 2008

(65) Prior Publication Data

US 2008/0304982 A1 Dec. 11, 2008

(30) Foreign Application Priority Data

Jun. 5, 2007 (JP) ..... 2007-148982
Feb. 6, 2008 (JP) ..... 2008-026012

(51) Int. Cl.
*F04B 35/00* (2006.01)
*F04B 17/00* (2006.01)

(52) U.S. Cl. ..... 417/360; 417/477.2

(58) Field of Classification Search ..... 417/477.2, 417/360, 474; 604/153
See application file for complete search history.

(56) References Cited

U.S. PATENT DOCUMENTS

| | | | | |
|---|---|---|---|---|
| 4,715,786 | A * | 12/1987 | Wolff et al. | 417/22 |
| 4,910,682 | A * | 3/1990 | Wolff et al. | 702/46 |
| 5,791,881 | A * | 8/1998 | Moubayed et al. | 417/63 |
| 7,478,999 | B2 * | 1/2009 | Limoges | 417/474 |
| 7,950,908 | B2 * | 5/2011 | Miyazaki et al. | 417/474 |
| 8,157,546 | B2 * | 4/2012 | Miyazaki et al. | 417/474 |
| 2005/0133625 | A1 * | 6/2005 | McLeod | 239/379 |

FOREIGN PATENT DOCUMENTS

| | | |
|---|---|---|
| JP | 3177742 | 11/1990 |
| JP | 2006-207414 | 8/2006 |

* cited by examiner

*Primary Examiner* — Devon Kramer
*Assistant Examiner* — Ryan Gatzemeyer
(74) *Attorney, Agent, or Firm* — Harness, Dickey & Pierce, P.L.C.

(57) ABSTRACT

A micropump of peristaltic drive system of pressing a tube having elasticity to transport a fluid is disclosed. The micropump includes: a pump module including the tube, a cam that presses the tube, and a cam shaft on which the cam is pivotally mounted; a drive module including a drive force transmission mechanism that transmits a drive force from a motor to the cam shaft; a coupling member that detachably couples the pump module and the drive module; and a linkage mechanism provided between the motor and the cam shaft to link the drive force.

16 Claims, 12 Drawing Sheets

MICROPUMP, PUMP MODULE, AND DRIVE MODULE

BACKGROUND

1. Technical Field

The present invention relates to a micropump formed by detachably coupling a pump module and a drive module.

2. Related Art

In the related art, a small peristaltic pump device including a pump module having a tube and a rotor pressing the tube and a motor module having a step motor and an output gear mechanism stacked and assembled, a gear as a linking element provided on a rotational shaft of the rotor, and a pinion as a power take-off mechanism provided in the output gear mechanism is known. When the pump module and the motor module are stacked and linked, the pinion and the gear are linked (meshed) and the drive force of the step motor is transmitted to the rotor (e.g., see Japanese Patent No. 3177742 (page 3, FIGS. 1 and 3).

In Japanese Patent No. 3177742, linkage of the drive force of the pump module and the motor module is made by meshing the pinion at the pump module side and the gear at the motor module side. However, when the pump module and the motor module are stacked and assembled, if the teeth of the pinion and the gear are out of phase with each other, it is conceivable that the pinion and the gear overlap each other and the pinion or gear may be broken. Further, even if it is not broken, there may be a problem that the step motor can not be driven due to overload.

Further, the step motor is contained in the motor module. In Japanese Patent No. 3177742, a structure adopting a step motor for watch is taken as an example. In the step motor, dimensions of the component elements are very small, and it is predicted that the durability can not be secured due to the load when the pump module is driven. The small peristaltic pump device is principally used for directly attaching to a human body for injection of a chemical solution, and therefore, the reliability and durability in driving of the step motor are important.

In this application, it is desirable that the motor module in no direct contact with the chemical solution is repeatedly used and the pump module for flowing the chemical solution is disposable. For the same reason, it is also desirable that the step motor is replaced after a predetermined period of driving. However, since the step motor is incorporated in the motor module, i.e., the watch movement, the step motor is not easily removed without a special technique.

Furthermore, if the pump module and the motor module are not properly assembled, there may be problems that the pinion and the gear are broken and the step motor can not be driven as described above. Therefore, a detection device for detecting whether or not they are properly assembled before driving is required.

SUMMARY

Some aspects of the invention can be realized as following modes and application examples.

Application Example 1

A micropump of the application example is a micropump of peristaltic drive system of pressing a tube having elasticity to transport a fluid, and the micropump includes: a pump module including the tube, a cam that presses the tube, and a cam shaft on which the cam is pivotally mounted; a drive module including a drive force transmission mechanism that transmits a drive force from a motor to the cam shaft; a coupling member that detachably couples the pump module and the drive module; and a linkage mechanism provided between the motor and the cam shaft to link the drive force.

According to the application example, the pump module and the drive module are detachably configured and one of the pump module and the drive module can be repeatedly used and the other one can be renewed after each use. When a chemical solution or the like is flowed, reliability can be improved by renewing after each use the pump module containing the tube in direct contact with the chemical solution and having lower durability than that of the other mechanisms. Further, when the drive module containing the motor has the lower durability than that of the pump module, the drive module may be renewed after each use.

Furthermore, since the linkage mechanism that links the drive force between the motor and the cam shaft is provided, the pump module and the drive module can be detached from each other without breakage of these parts and mechanisms.

Moreover, since the coupling member that detachably couples the pump module and the drive module is provided, the pump module and the drive module can easily be detached from each other.

Application Example 2

In the micropump according to the above described application example, it is preferable that the drive module includes the drive force transmission mechanism having a cam drive wheel detachable from the cam shaft and the motor, and the linkage mechanism includes a fitting hole having a non-circular section provided in the cam shaft or the cam drive wheel, a cam drive shaft part having a non-circular section provided in the cam drive wheel or the cam shaft, and a first elastic member that urges one of the cam shaft and the cam drive wheel in a direction in which the fitting hole and the cam drive shaft part are linked.

According to the configuration, the configuration of the pump module is simpler than that of the drive module containing the motor, and there is an advantage that the running cost can be reduced by renewing the pump module after each use.

Further, the pump module and the drive module are stacked and coupled. In this regard, the cam shaft of the pump module and the cam drive wheel are fitted and coupled (fitted and linked) between the fitting hole and the cam drive shaft. Therefore, the rigidity of the coupling structure is higher than that of the coupling (link) structure by meshing a pinion with a gear in the related art.

Furthermore, when a leaf spring is used as the first elastic member that urges the cam drive wheel or the can shaft in the link direction, the stable urging force can be provided and the configuration can be realized without increasing the dimension in the thickness direction.

Application Example 3

In the micropump according to the above described application example, it is preferable that, in the case where the pump module and the drive module are coupled, when the cam drive shaft part and the fitting hole are out of phase in a rotational direction, an end of the cam drive shaft part and a peripheral edge of the fitting hole are in contact, and when the cam drive wheel rotates and the cam drive shaft part and the fitting hole are in phase in the rotational direction, the first elastic member moves the cam drive wheel or the cam shaft in a direction toward each other, and the cam drive shaft part and the fitting hole are fitted and linked.

According to the configuration, there is an advantage that the cam drive shaft part and the fitting hole can be fitted and linked not by artificial operation but by rotation of the motor and the drive of the motor can be transmitted to the cam.

Further, when the end of the cam drive shaft part and the peripheral edge of the fitting hole are out of phase and not fitted but in contact, the cam shaft and the cam drive wheel are hardly broken because the urging force of the first elastic member is applied to them only in the shaft direction.

Application Example 4

In the micropump according to the above described application example, it is preferable that the pump module includes the motor having a motor drive shaft, the drive module includes a cam drive wheel and the drive force transmission mechanism having a motor transmission wheel, and the linkage mechanism includes: a fitting hole having a non-circular section provided in the cam shaft or the cam drive wheel; a cam drive shaft part having a non-circular section provided in the cam drive wheel or the cam shaft; a first elastic member that urges one of the cam shaft and the cam drive wheel in a direction in which the fitting hole and the cam drive shaft part are linked; the motor drive shaft having a non-circular section; a motor shaft fitting hole having a non-circular section provided in the motor transmission wheel; and a second elastic member that urges the motor transmission wheel in a direction in which the motor drive shaft and the motor shaft fitting hole are linked.

When the micropump is attached to a living body, an extremely small motor is used. Naturally, the dimensions of component elements of the motor are very small, and it is predicted that the durability may not be secured due to the load when the pump module is driven. In this case, it is preferable that the pump module can be replaced including the motor at the time of replacement of the pump module. Therefore, since the motor is provided in the pump module, it is not necessary to detach the motor singly from the pump module and the motor can be replaced together at the replacement of the pump module.

Further, when the pump module and the drive module are coupled, the cam shaft and the cam drive wheel are linked and the motor drive shaft provided at the pump module side and the motor transmission wheel provided the drive module side are linked by fitting, and thereby, the drive force of the motor can be transmitted to the cam.

Application Example 5

In the micropump according to the above described application example, it is preferable that, in the case where the pump module and the drive module are coupled, when the cam drive shaft part and the fitting hole are out of phase in a rotational direction, an end of the cam drive shaft part and a peripheral edge of the fitting hole are in contact, when the cam drive wheel rotates and the cam drive shaft part and the fitting hole are in phase in the rotational direction, the first elastic member moves the cam drive wheel or the cam shaft in a direction toward each other and the cam drive shaft part and the fitting hole are fitted and linked, and, when the motor drive shaft and the motor shaft fitting hole are out of phase in the rotational direction, an end of the motor drive shaft and a peripheral edge of the motor shaft fitting hole are in contact, and when the motor drive shaft rotates and the motor drive shaft and the motor shaft fitting hole are in phase in the rotational direction, the second elastic member moves the motor transmission wheel toward the shaft direction of the motor drive shaft and the motor drive shaft and the motor shaft fitting hole are fitted and linked.

According to the configuration, in the case where the pump module and the drive module are coupled, when the end of the motor drive shaft and the peripheral edge of the fitting hole are out of phase and not fitted but in contact, the motor and the motor transmission wheel are hardly broken because the urging force of the second elastic member is applied to them only in the shaft direction.

Further, when the motor drive shaft rotates and the motor drive shaft and the motor shaft fitting hole are in phase in the rotational direction, the motor transmission wheel is urged by the second elastic member and fitted and linked to the motor, and thus, it is not necessary to artificially link the motor and the motor transmission wheel.

Application Example 6

In the micropump according to the above described application example, it is preferable that the pump module includes the tube, the cam, the cam shaft, and the motor on which a motor transmission wheel is pivotally mounted, the drive module includes the drive force transmission mechanism having a cam drive wheel that transmits the drive force of the motor to the cam shaft and a first transmission wheel, and the linkage mechanism includes: a fitting hole having a non-circular section provided in the cam shaft or the cam drive wheel; a cam drive shaft part having a non-circular section provided in the cam drive wheel or the cam shaft; a first elastic member that urges one of the cam shaft and the cam drive wheel in a direction in which the fitting hole and the cam drive shaft part are linked; and a third elastic member that urges the first transmission wheel in a shaft direction to mesh with the motor transmission wheel.

According to the configuration, the pump module can be replaced including motor at the time of replacement. Further, when the pump module and the drive module are coupled, the cam shaft and the cam drive wheel are linked and the motor transmission wheel pivotally mounted on the motor provided at the pump module side and the first transmission wheel provided at the drive module side are meshed and linked, and thereby, the drive force of the motor can be transmitted to the cam.

Application Example 7

In the micropump according to the above described application example, it is preferable that, in the case where the pump module and the drive module are coupled, when the cam drive shaft part and the fitting hole are out of phase in a rotational direction, an end of the cam drive shaft part and a peripheral edge of the fitting hole are in contact, when the cam drive wheel rotates and the cam drive shaft part and the fitting hole are in phase in the rotational direction, the first elastic member moves the cam drive wheel or the cam shaft in a direction toward each other and the cam drive shaft part and the fitting hole are fitted and linked, and, when a gear part of the motor transmission wheel and a transmission gear of the first transmission wheel are out of phase in a rotational direction, the gear part and the transmission gear are overlapped, and when the motor transmission wheel rotates and the gear part and the transmission gear are in phase in the rotational direction, the third elastic member moves the first transmission wheel in a shaft direction and the first transmission wheel and the motor transmission wheel are meshed and linked.

According to the configuration, the pump module can be replaced including motor at the time of replacement. Further, when the pump module and the drive module are coupled, if the teeth of the motor transmission wheel and the transmission gear of the first transmission wheel are out of phase in the rotational direction, the gear part of the motor transmission wheel and the transmission gear of the first transmission wheel are overlapped, but the motor transmission wheel and the first transmission wheel are hardly broken because the urging force of the third elastic member is applied to them only in the shaft direction.

Further, when the motor transmission wheel rotates by the drive force of the motor and the gear part of the motor transmission wheel and the transmission gear of the first transmission wheel are in phase in the rotational direction, the first transmission wheel is urged and moved by the third elastic member toward the other and meshed and linked, and thereby, the drive force from the motor can be transmitted to the cam shaft to drive the cam.

Therefore, in the related art, it is necessary to assemble with the pinion and the gear in phase, however, in the application example, is not necessary to assemble the gear part of the motor transmission wheel and the transmission gear of the first transmission wheel in phase with each other, but they are meshed and coupled to each other by driving the motor, and thereby, the ease of assembly can be improved.

The cam shaft contained in the pump module and the cam drive wheel contained in the drive module can be coupled in the same manner as in the application example 2 and the same advantage is obtained.

Application Example 8

In the micropump according to the above described application example, it is preferable that the linkage mechanism has at least two projections on one end and at least two depressions on the other end, the ends opposed to each other between the pump module and the drive module, and when the pump module and the drive module are coupled, the projections and the depressions are engaged and the drive force transmission mechanism is linked between the motor and the cam shaft.

According to the configuration, the drive link between the pump module and the drive module can be established by the opposed depressions and projections, and thus, the structure can be simplified.

Application Example 9

In the micropump according to the above described application example, it is preferable that the projections and the depressions are formed of crown gears, respectively.

According to the configuration, given that the number of teeth of the crown gears is n, they may be rotated 1/n revolution for meshing with each other, and they can be meshed and linked promptly.

Application Example 10

In the micropump according to the above described application example, it is preferable that the coupling member has a flange part that presses a flange part provided on an outer periphery of the drive module and a thread screwed in a thread provided on an outer periphery of the pump module, and the pump module and the drive module are screwed and coupled by the coupling member.

In such a coupling structure, the pump module may be likened to a bolt and the coupling member is likened to a nut. That is, the coupling structure is a bolt and nut coupling structure, and the pump module and the drive module can be easily coupled by fastening the coupling member and also easily detached from each other.

Application Example 11

In the micropump according to the above described application example, it is preferable that the drive module has a coupling member pressing part provided on the outer periphery thereof, the pump module has a coupling member fixing groove provided on the outer periphery thereof in a circumferential direction and a coupling member insertion groove that nearly vertically communicates with the coupling member fixing groove, the coupling member includes a drive module fixing flange that pressing the coupling member pressing part and a pump module fixing flange inwardly projected, and the pump module fixing flange is inserted into the coupling member insertion groove, and then, the pump module and the drive module are coupled by rotating the coupling member along the coupling member fixing groove.

According to the configuration, the pump module fixing flange of the coupling member is inserted into the coupling member insertion groove of the pump module and rotated along the coupling member fixing groove, and thereby, the pump module and the drive module can be easily coupled.

Further, when the coupling member is rotated to the position of the coupling member insertion groove in the opposite direction along the coupling member fixing groove, and thereby, they can be easily detached.

Application Example 12

In the micropump according to the above described application example, it is desirable to further include a detection device that detects that the pump module and the drive module are coupled to each other in a predetermined position.

As the detection method, for example, contact detection, photodetection, or the like may be adopted.

Since the detection device is provided, the coupling state between the pump module and the drive module can be detected and the micropump can be used at ease by detecting the coupling condition in the predetermined state and continuing to drive the motor.

Application Example 13

In the micropump according to the above described application example, it is preferable that the detection device has a first detection terminal provided in one of the pump module and the drive module and a second detection terminal provided in the other one and having elasticity, and when connection between the first detection terminal and the second detection terminal is detected, driving of the motor is continued.

Such a configuration is for contact detection, and driving of the micropump can be continued at ease by determining that the pump module and the drive module are coupled in the predetermined state while the connection between the first detection terminal and the second detection terminal is electrically ON.

Application Example 14

In the micropump according to the above described application example, it is preferable that the second detection terminal is a first elastic member, a second elastic member, or a third elastic member provided in the linkage mechanism.

According to the configuration, since the second detection terminal is the first elastic member, the second elastic member, or the third elastic member, there is no need to provide any detection terminal exclusively for detection, and the structure can be simplified.

Application Example 15

In the micropump according to the above described application example, it is preferable that, after the motor is driven, if the detection device does not detect coupling of the pump module and the drive module when the cam drive wheel rotate at least one revolution, driving of the motor is stopped.

In this manner, when the pump module and the drive module is not coupled in the predetermined state, driving of the motor is stopped. Therefore, there is an advantage that driving of the micropump is hardly continued unless the fluid is normally transported.

Application Example 16

In the micropump according to the above described application example, it is desirable that a positioning member that makes positions of the pump module and the drive module in a planar direction the same before the drive force transmission mechanism is linked between the motor and the cam shaft by the linkage mechanism is provided in the pump module or the drive module.

According to the configuration, the positions of the pump module and the drive module in the planar direction are controlled by the positioning member. Thereby, also the correct position of the linkage mechanism is controlled and the pump module and the drive module are reliably coupled.

Application Example 17

A pump module of the application example is a pump module detachable from a drive module including a drive force transmission mechanism that transmits a drive force from a motor to a cam, and the pump module includes a tube having elasticity, the cam that presses the tube to transport a fluid, and a cam shaft on which the cam is pivotally mounted.

According to the application example, the pump module and the drive module are detachably configured and one of the pump module and the drive module can be repeatedly used and the other one can be renewed after each use. When a chemical solution or the like is flowed, reliability can be improved by renewing after each use the pump module containing the tube in direct contact with the chemical solution and having lower durability than that of the other mechanisms.

Application Example 18

It is preferable that the pump module according to the above described application example includes the tube, the cam, and the cam shaft.

The pump module having the configuration can realize a simple configuration with less component elements and the running cost can be reduced when the pump module is renewed after each use.

Application Example 19

It is preferable that the pump module according to the above described application example includes the tube, the cam, the cam shaft, and the motor.

According to the configuration, since the motor is provided in the pump module, it is not necessary to detach the motor singly from the pump module and the motor can be replaced together at the replacement of the pump module.

Application Example 20

It is preferable that the pump module according to the above described application example includes the tube, the cam, the cam shaft, the motor, and a motor transmission wheel pivotally mounted on the motor and meshed with a first transmission wheel linked to the motor.

Also, in the configuration, since the motor is provided in the pump module, it is not necessary to detach the motor singly from the pump module and the motor can be replaced together at the replacement of the pump module.

Application Example 21

A drive module of the application example is a drive module detachable from a pump module including a tube having elasticity, a cam that presses the tube, and a cam shaft on which the cam is pivotally mounted, and the drive module includes a drive force transmission mechanism including a cam drive wheel that transmits a drive force from a motor to the cam.

According to the application example, the pump module and the drive module are detachably configured and one of the pump module and the drive module can be repeatedly used and the other one can be renewed after each use.

Application Example 22

It is preferable that the drive module according to the application example includes the motor and the drive force transmission mechanism.

The drive module having the configuration includes the motor and the drive force transmission mechanism and it is predicted that the cost may be higher than that of the pump module. Therefore, the running cost can be reduced by repeatedly using the drive module.

Application Example 23

It is preferable that the drive module according to the application example includes the drive force transmission mechanism including a motor transmission wheel linked to the motor.

According to the configuration, since the motor is provided in the pump module, it is not necessary to detach the motor singly from the pump module and the motor can be replaced together at the replacement of the pump module.

Application Example 24

It is preferable that the drive module according to the application example includes the drive force transmission mechanism including a first transmission wheel linked to the motor.

Also, in the configuration, since the motor is provided in the pump module, it is not necessary to detach the motor singly from the pump module and the motor can be replaced together at the replacement of the pump module.

BRIEF DESCRIPTION OF THE DRAWINGS

The invention will be described with reference to the accompanying drawings, wherein like numbers reference like elements.

FIG. 2A is a perspective view showing the pump module, FIG. 2B is a perspective view showing the drive module, and FIG. 2C is a perspective view showing a coupling member.

FIG. 4A is an explanatory diagram showing an out-of-phase condition, FIG. 4B is a partial sectional view showing a relationship between the cam shaft and the cam drive wheel in the out-of-phase condition, and FIG. 4C is an explanatory diagram showing an in-phase condition.

FIG. 7A is a partial sectional view and FIG. 7B is a plan view showing a second detection terminal of the contact detection device.

FIG. 10A is a partial sectional view showing link between the cam shaft and the cam drive wheel, FIG. 10B is a partial sectional view showing link between a motor drive shaft and a motor transmission wheel, and FIG. 10C is a partial sectional view showing another example.

FIG. 14A is a perspective view showing the pump module and FIG. 14B is a perspective view showing a part of the coupling member.

DESCRIPTION OF EXEMPLARY EMBODIMENTS

Hereinafter, embodiments of the invention will be described with reference to the drawings.

Figure 6:
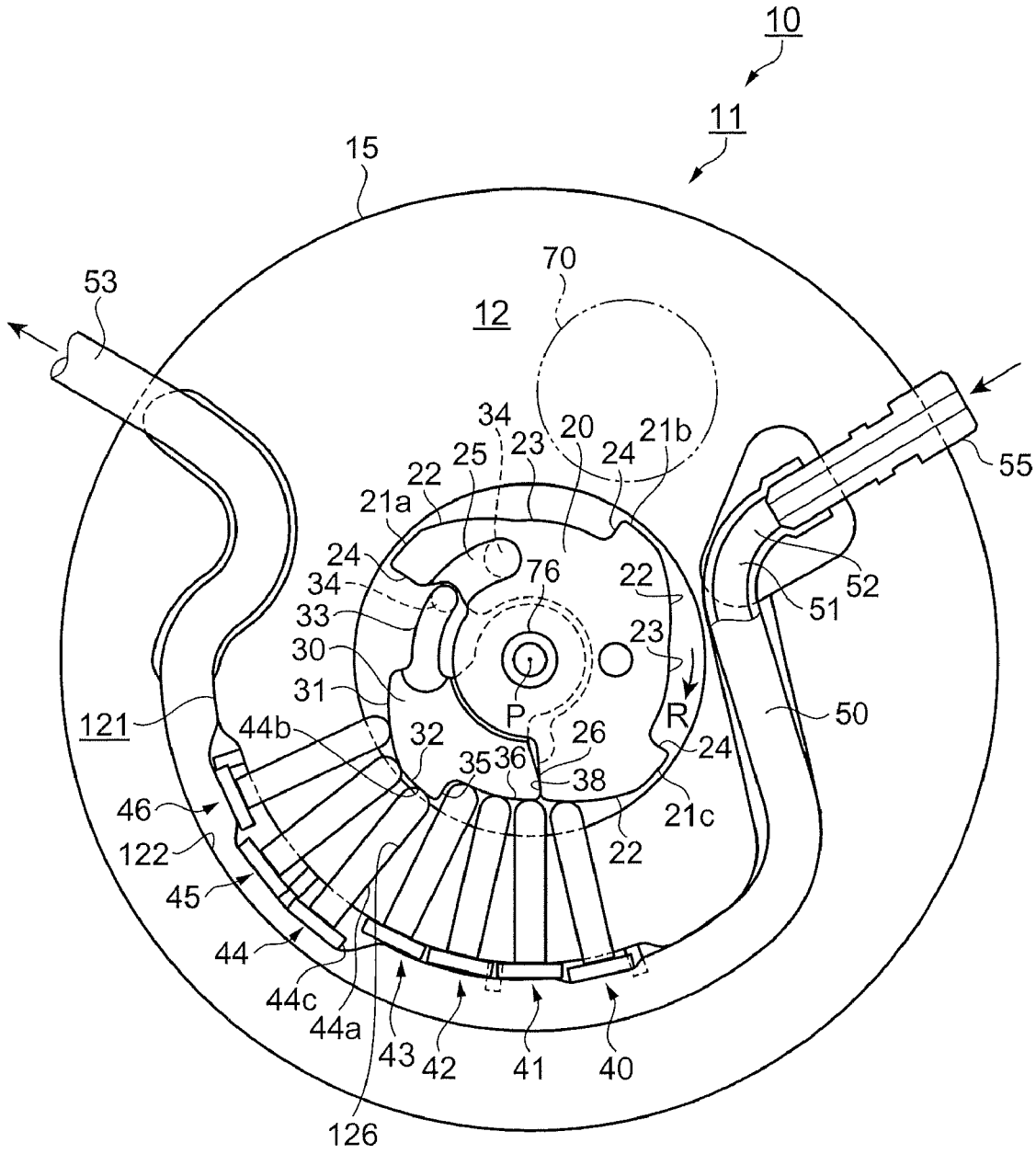
FIG. 6 is a plan view showing a schematic structure of the pump module according to embodiment 1.
Figure 7A:
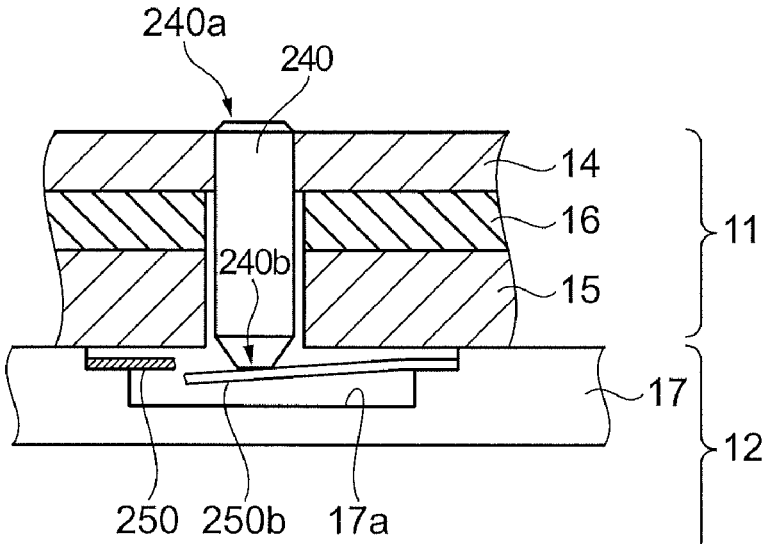
FIGS. 7A and 7B show an example of a detection device according to embodiment 1.
Figure 7B:
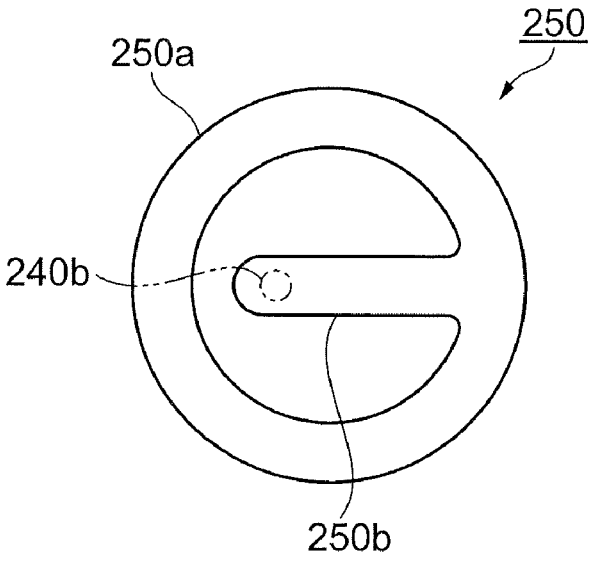
Figure 8:
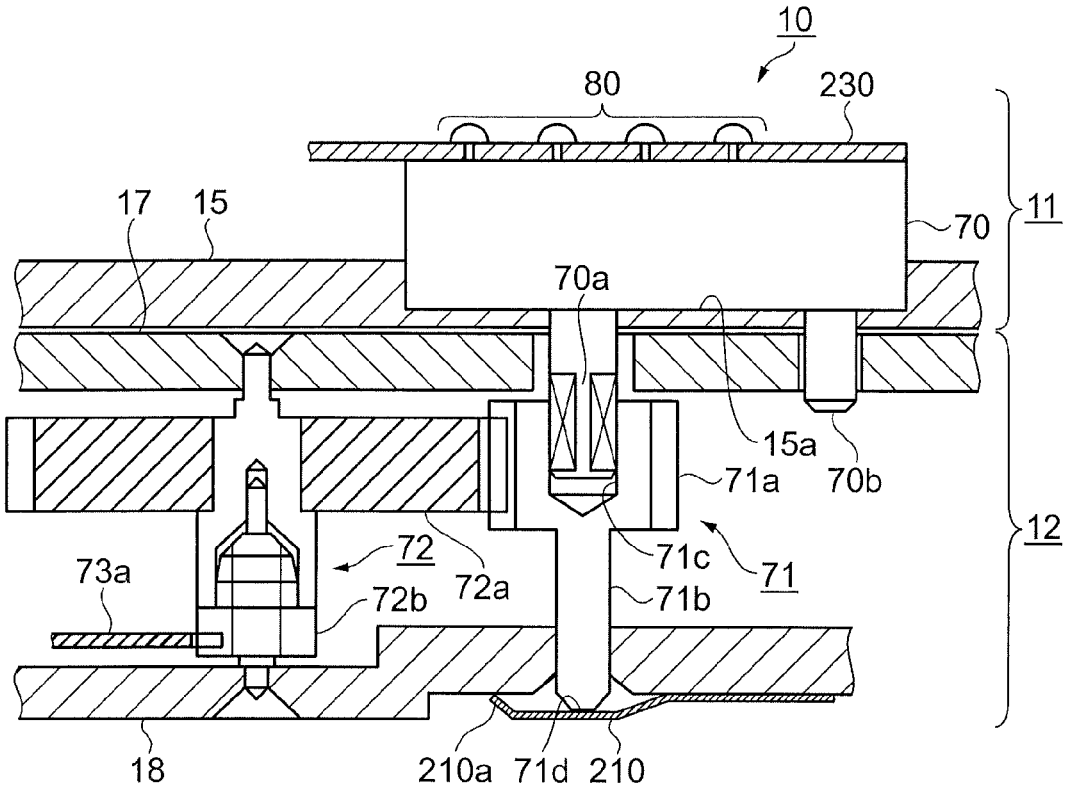
FIG. 8 is a partial sectional view showing a micropump according to embodiment 2 (coupled).
Figure 9:
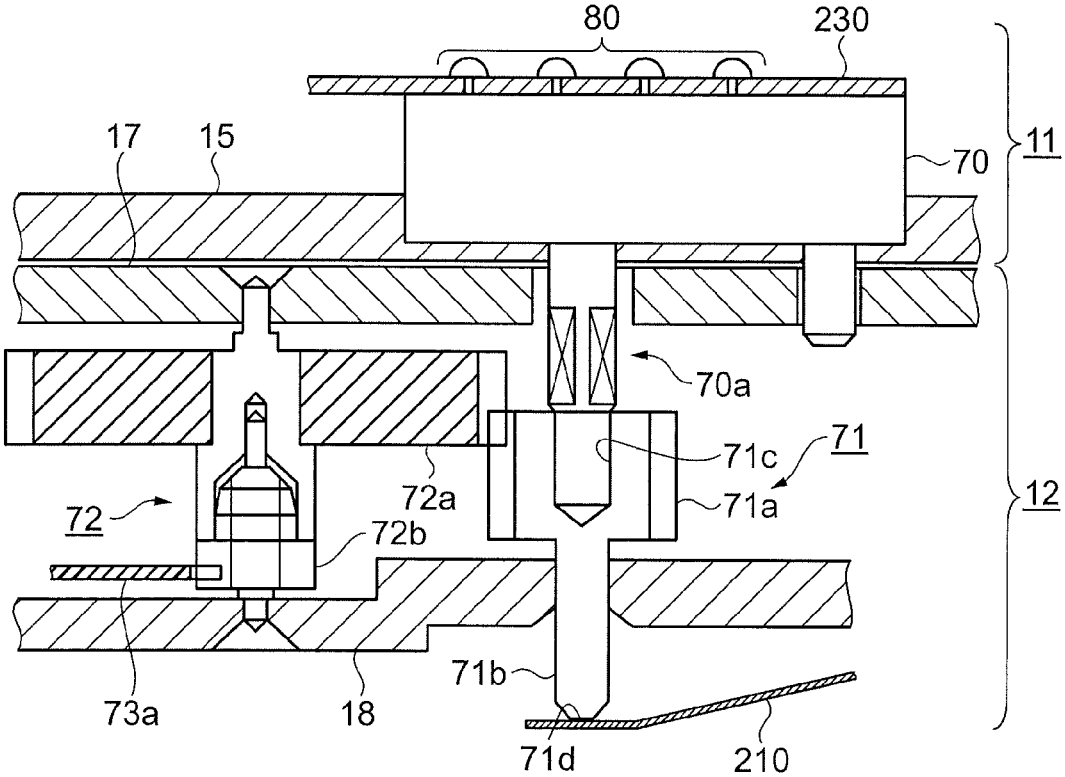
FIG. 9 is a partial sectional view showing the micropump according to embodiment 2 (before coupled).
Figure 10C:
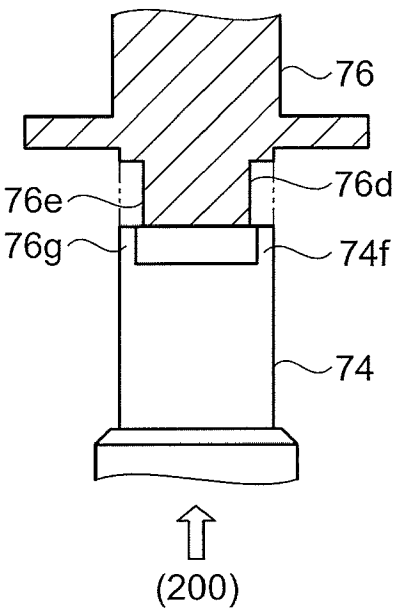
FIGS. 10A to 10C show linkage mechanisms according to embodiment 3.
Figure 10B:
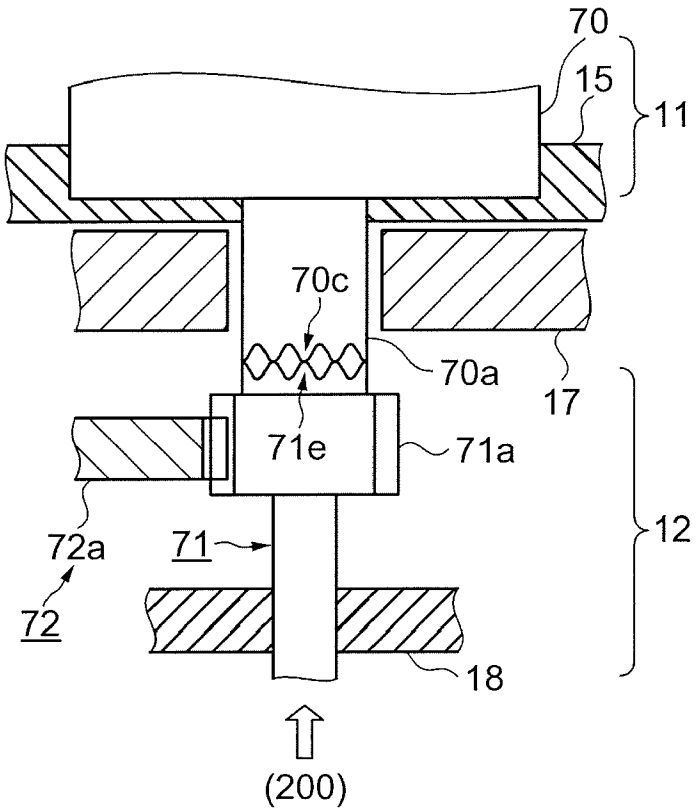
Figure 10A:
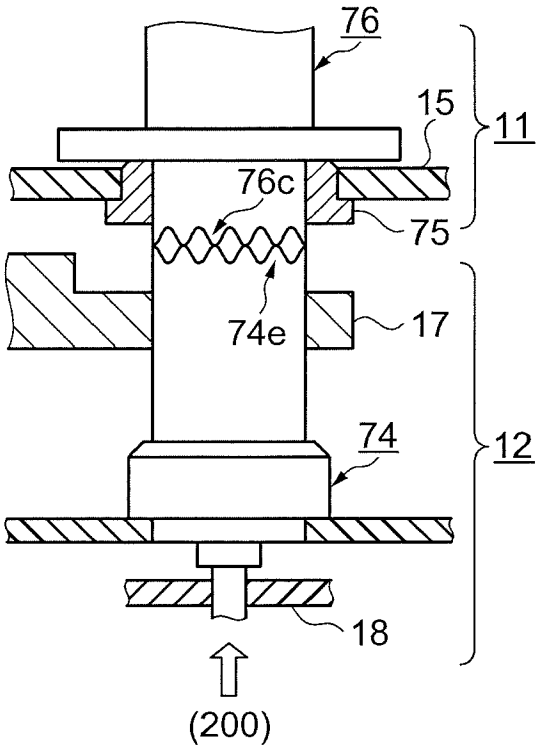
Figure 11:
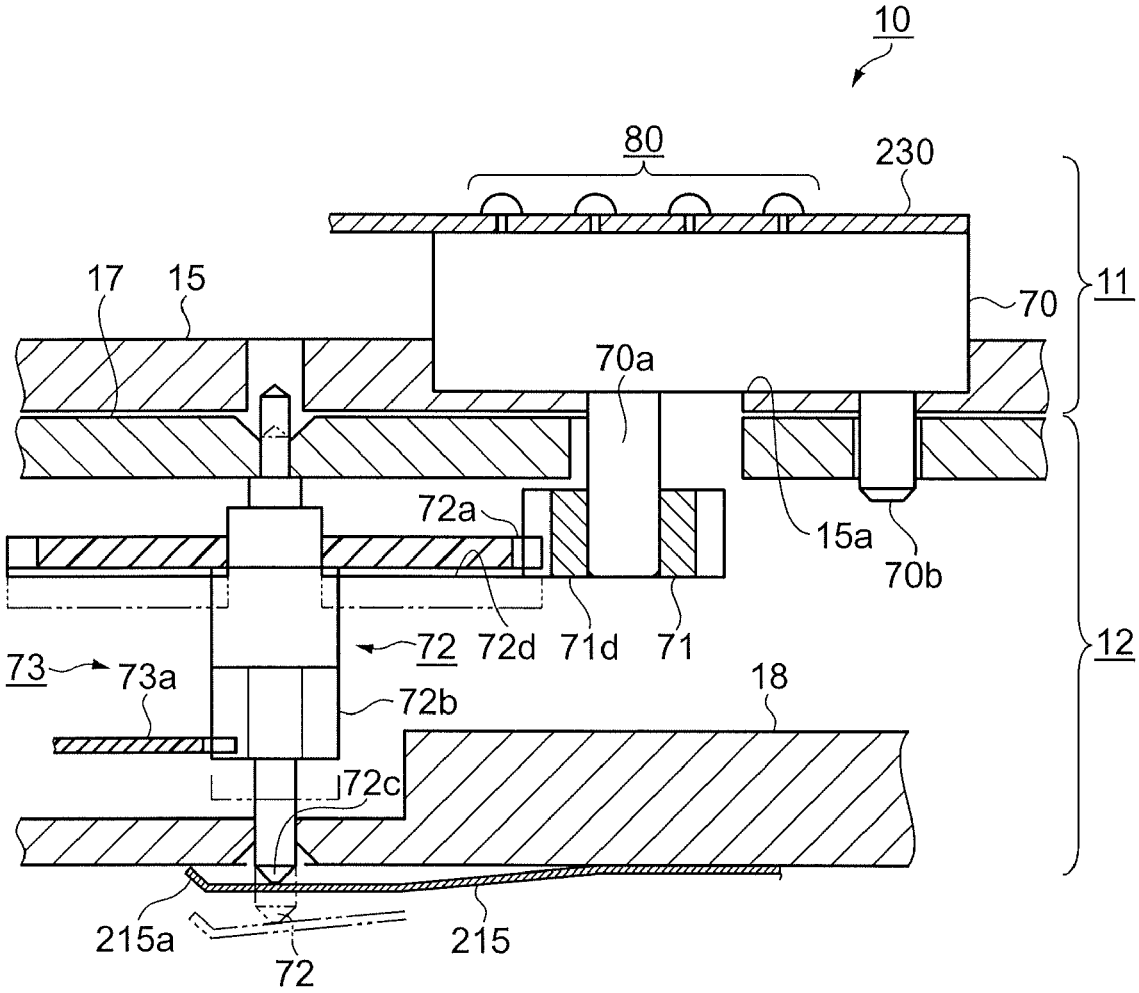
FIG. 11 is a partial sectional view showing a structure of a micropump according to embodiment 4.
Figure 12:
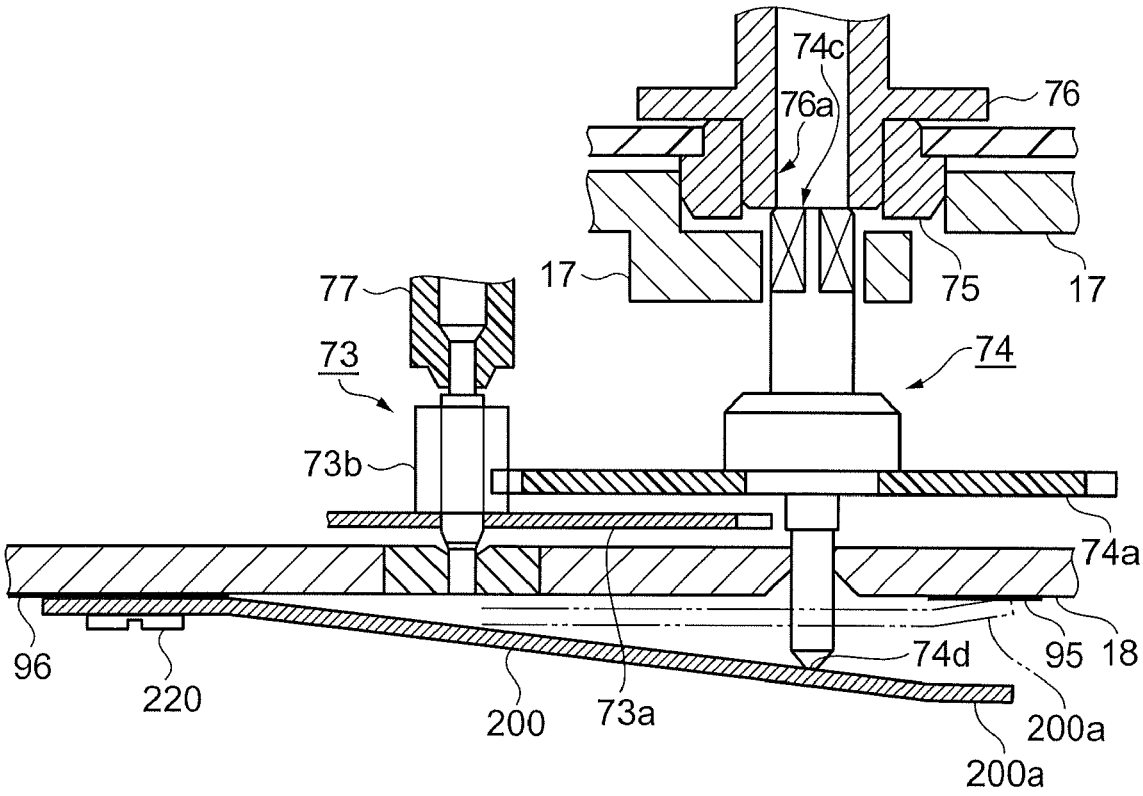
FIG. 12 is a partial sectional view showing a detection device according to embodiment 5.
Figure 13:
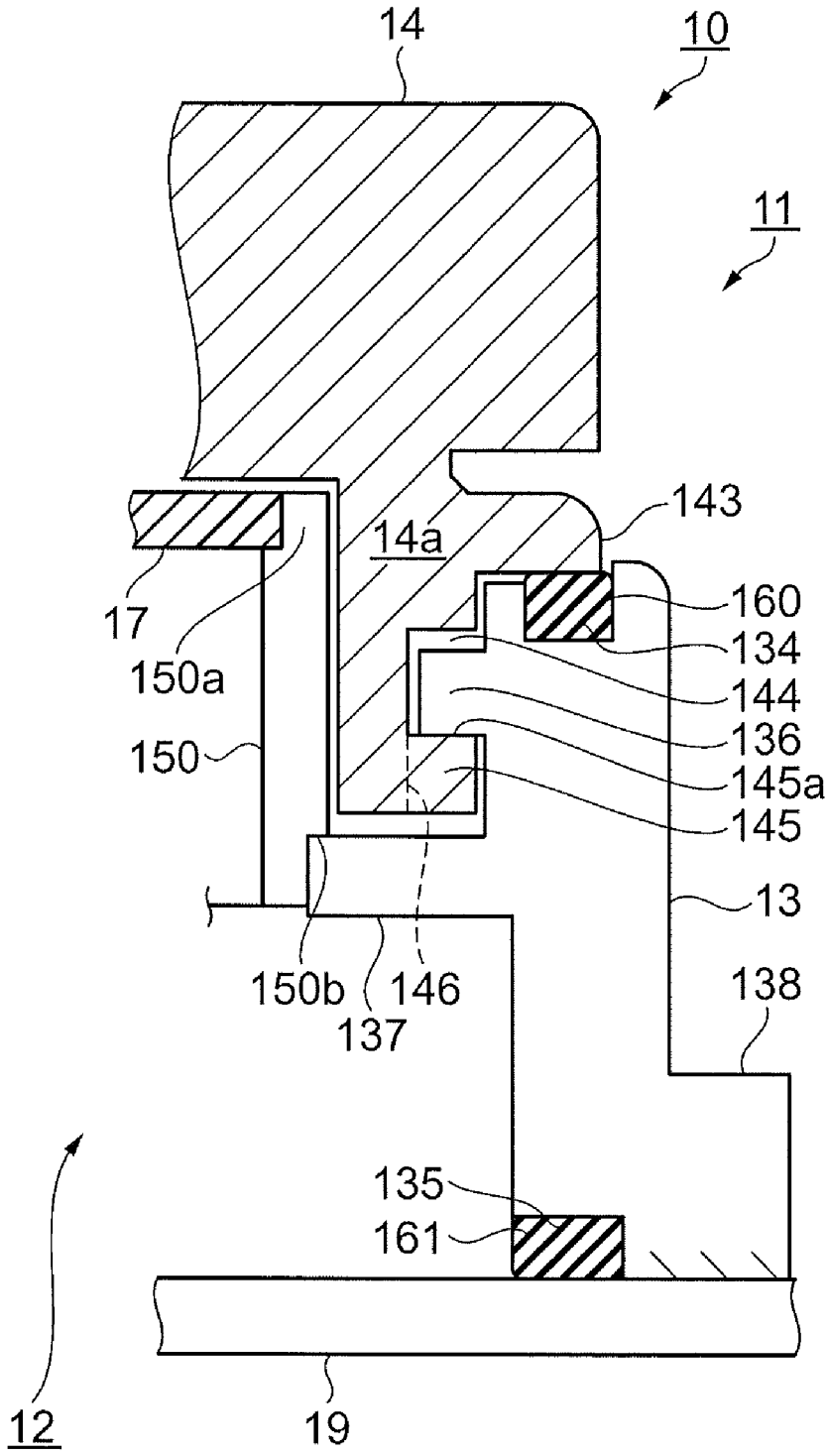
FIG. 13 is a partial sectional view showing a coupling structure according to embodiment 6.
Figure 14A:
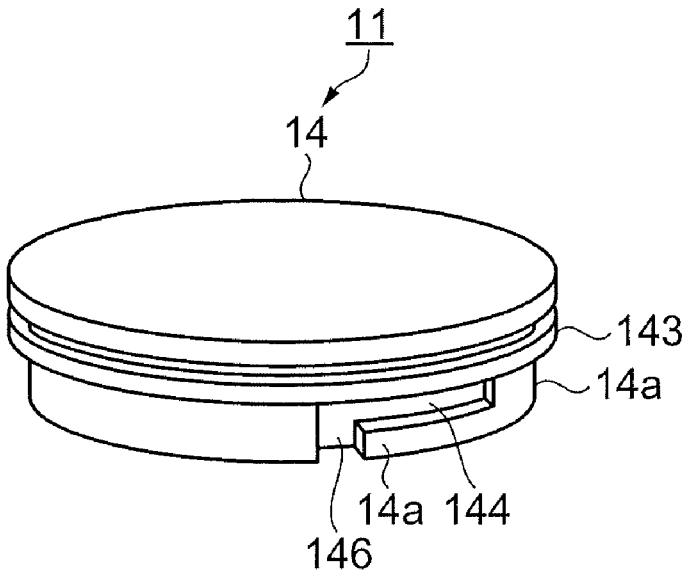
FIGS. 14A and 14B are explanatory diagrams showing a coupling method.
Figure 14B:
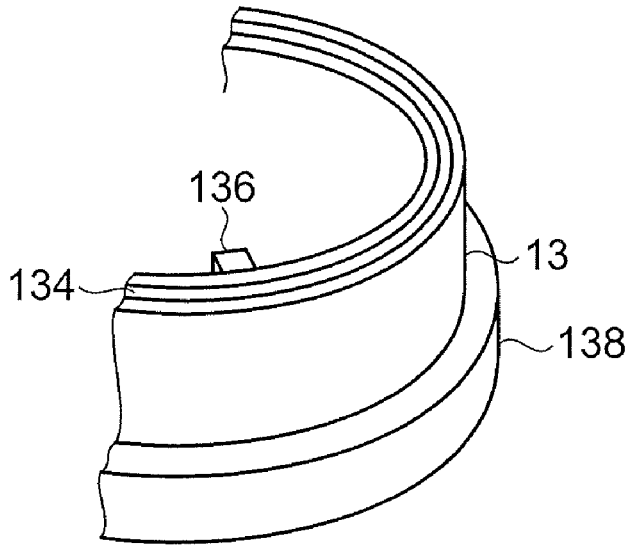

FIGS. 1 to 7B show a micropump according to embodiment 1, FIGS. 8 and 9 show a micropump according to embodiment 2, FIGS. 10A to 10B show a micropump according to embodiment 3, FIG. 11 shows a micropump according to embodiment 4, FIG. 12 shows a micropump according to embodiment 5, and FIGS. 13 to 14B show a micropump according to embodiment 6.

For convenience of illustration, the drawings referred to in the following description are schematic diagrams showing members and parts in different longitudinal and lateral scales from those in actual configurations.

Embodiment 1

Figure 1:
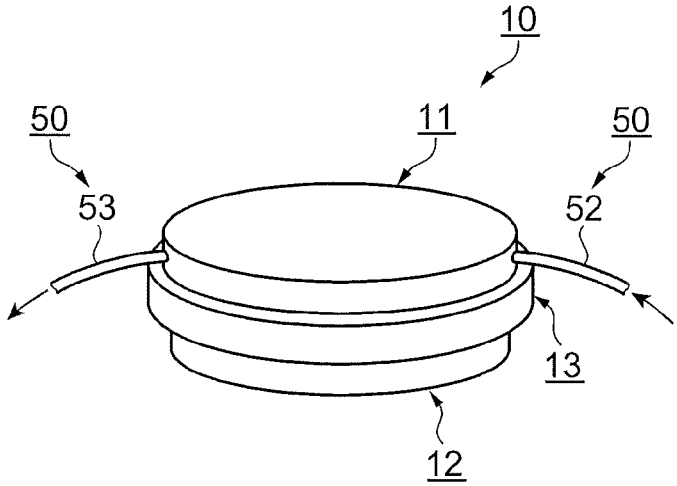
FIG. 1 is a perspective view showing a schematic configuration of a micropump according to embodiment 1.

FIG. 1 is a perspective view showing a schematic configuration of one mode of the micropump according to embodiment 1. In FIG. 1, the micropump 10 includes a pump module 11 containing a cam that presses a tube 50 having elasticity and a cam shaft that transmits a drive force to the cam, a drive module 12 containing a motor as a drive source and a drive force transmission mechanism that transmits the drive force to the cam shaft, and a coupling member 13 that detachably couples the pump module 11 and the drive module 12.

In the tube 50 contained in the pump module 11, an inlet 52 that enters a liquid from a reservoir containing the liquid (not shown) and an outlet 53 that discharges the liquid are projected from the pump module 11. The reservoir may be provided inside the pump module 11.

The pump module 11 and the drive module 12 are stacked and closely secured by the coupling member 13.

Figure 2A:
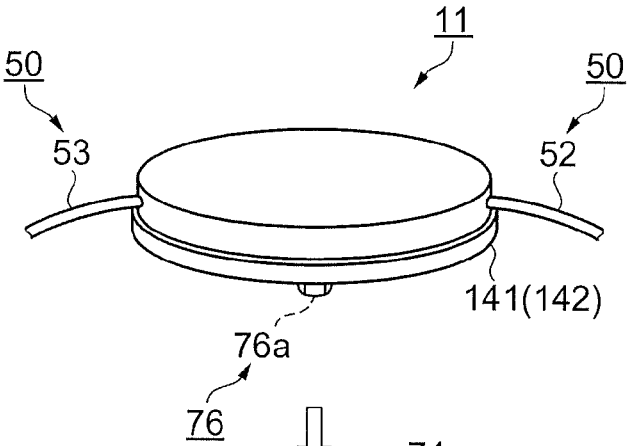
FIGS. 2A to 2C are assembly and disassembly diagrams of a pump module and a drive module forming the micropump according to embodiment 1.
Figure 2B:
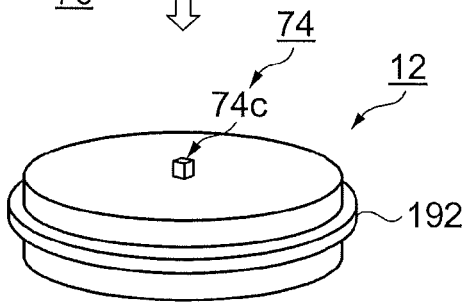
Figure 2C:
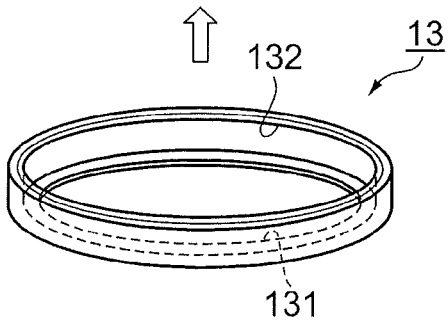

FIGS. 2A to 2C are assembly and disassembly diagrams of the pump module 11 and the drive module 12 forming the micropump. FIG. 2A is a perspective view showing the pump module 11, FIG. 2B is a perspective view showing the drive module 12, and FIG. 2C is a perspective view showing the coupling member 13. In FIGS. 2A to 2C, the cam shaft 76 is provided to appear on the lower part of the pump module 11 (at the drive module 12 side). A cam drive wheel fitting hole 76*a* having a non-circular section as one of linkage mechanisms is provided in the cam shaft 76.

On the other hand, a cam drive wheel 74 as the other one of the linkage mechanisms is provided to appear on the upper part of the drive module 12 (at the pump module 11 side). A cam drive shaft part 74*c* having a non-circular section is formed on the end of the cam drive wheel 74.

The non-circular section means that the sectional shape is polygonal, oval, knurled, or the like. The shape is not limited as long as the drive force can be transmitted from the cam drive wheel 74 to the cam shaft 76 when the cam drive wheel fitting hole 76*a* and the cam drive shaft part 74*c* are fitted and coupled. As below, in the embodiment, the case of the square sectional shape will be described as an example.

When the pump module 11 and the drive module 12 are stacked, the cam drive wheel fitting hole 76*a* and the cam drive shaft part 74*c* are fitted and coupled. The pump module 11 and the drive module 12 are coupled by the coupling member 13. The coupling member 13 is a tubular member. A flange part 131 is projected from one end toward inside, and a female thread 132 is formed at the inner side of the tubular part. Further, a male thread 142 is formed on the outer periphery of a flange part 141 of the pump module 11. Furthermore, a flange part 192 projected from the outer periphery is provided on the drive module 12.

After the pump module 11 and the drive module 12 are stacked, the coupling member 13 is inserted from the drive module 12 side. Then, the female thread 132 of the coupling member 13 and the male thread 142 of the pump module 11 are screwed together. By pressing the flange part 192 of the drive module 12 toward the pump module 11 side with the flange part 131 of the coupling member 13, the pump module 11 and the drive module 12 are integrated.

Next, an internal structure of the micropump 10 according to the embodiment will be described.

Figure 3:
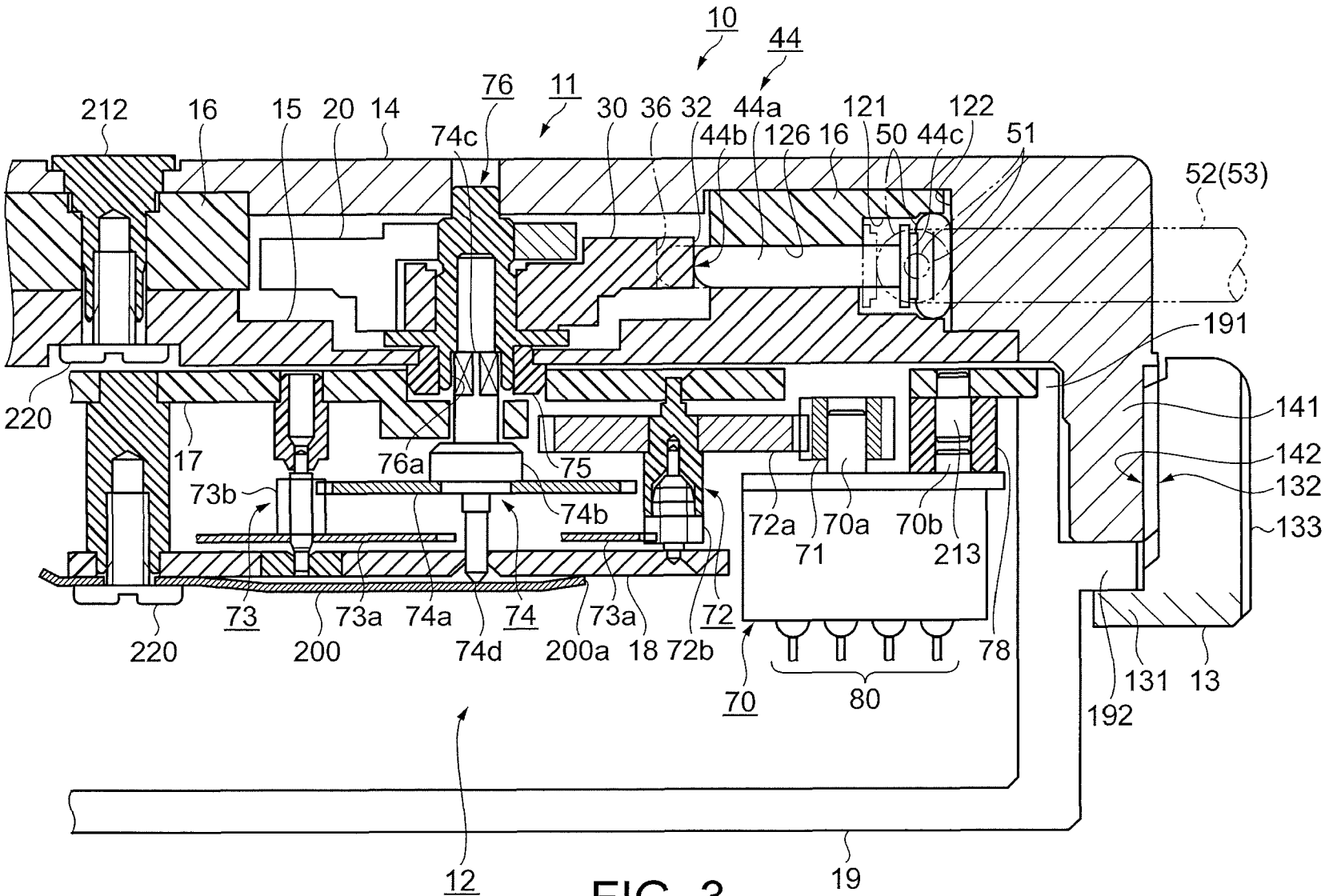
FIG. 3 is a partial sectional view showing a structure of the micropump according to embodiment 1.

FIG. 3 is a partial sectional view showing a structure of the micropump according to the embodiment. In FIG. 3, the drive module 12 includes a motor 70 as a drive source and transmits the drive (rotation) of the motor 70 to a motor transmission wheel 71, a first transmission wheel 72, a second transmission wheel 73, and the cam drive wheel 74. In the embodiment, the wheel train including the motor transmission wheel 71, the first transmission wheel 72, the second transmission wheel 73, and the cam drive wheel 74 is a drive force transmission mechanism.

The first transmission wheel 72 includes a transmission gear 72*a* and a pinion 72*b*, the second transmission wheel 73 includes a transmission gear 73*a* and a pinion 73*b*, and the cam drive wheel 74 includes a transmission gear 74*a* and a drive shaft 74*b*. Further, a support shaft part 74*d* is provided on one end of the drive shaft 74*b*, and a cam drive shaft part 74*c* is provided on the other end thereof. The support shaft part 74*d* is inserted into a fourth frame 18, and the cam drive shaft part 74*c* is inserted into the cam drive wheel fitting hole 76*a* drilled in the cam shaft 76 at the pump module 11 side.

The cam drive shaft part 74*c* and the cam drive wheel fitting hole 76*a* have square sectional shapes, and their dimensions are set so that they may be inserted in a loose fit and fitted to transmit the rotational force to each other. The details will be described later with reference to FIGS. 4A to 4C.

The cam drive wheel 74 is urged toward the cam shaft 76 by a cam drive wheel spring 200 as a first elastic member at the end of the support shaft part 74*d*. The cam drive wheel spring 200 is a leaf spring with a tail secured to the fourth frame 18 by a securing screw 220 and a leading end 200*a* in contact with the surface of the fourth frame 18. The spring reduces the load in the shaft direction when the cam drive wheel 74 and the cam shaft 76 are fitted. Accordingly, it is more preferable that the end shape of the support shaft part 74*d* of the cam drive wheel 74 is smoothly finished.

The motor 70 is a small step motor. Though not shown, the motor 70 has a four-pole rotor inside and pairs of stators and coils facing the rotor. The motor 70 is attached to a third frame 17 by inserting and securing protruded motor guide shafts 70*b* (two exist) into a motor holding frame 78 and inserting the motor holding frame into a motor fixing shaft 213 protruded from the third frame 17. A plurality of the motor fixing shafts 213 are provided. The motor 70 has the pair of coils and is connected to four (two pairs of) connecting terminals 80. Further, the connecting terminals 80 are connected to a circuit block (not shown).

The circuit block is provided inside the drive module 12, and a circuit group including a control circuit for drive-control of the motor 70, a memory, a power supply control circuit, and a detection circuit is mounted on a circuit substrate.

Further, the drive module 12 is sealed by a rear cover 19. The rear cover 19 has a container-like shape and contains the above described functional elements between the third frame 17 and itself by press-fitting a fixing portion 191 at the edge into the outer periphery portion of the third frame 17.

Next, a structure of the pump module 11 will be described with reference to FIG. 3. The pump module 11 includes cams of a first cam 20 and a second cam 30 nearly at the center, a finger group (a finger 44 is illustrated in FIG. 3 though plural fingers are provided) to be pushed by the first cam 20 and the second cam 30, a tube 50 to be pressed by the finger group, and a first frame 14, a second frame 15, and a tube frame 16 for holding them.

The first cam 20 is pivotally mounted on the cam shaft 76. Further, the second cam 30 is rotatably journaled on the cam shaft 76 and the position in the shaft direction is controlled by the first cam 20 and the flange parts of the cam shaft 76. The first cam 20 and the second cam 30 respectively have finger pressing parts at the outer peripheries (a finger pressing part 32 of the second cam 30 is illustrated in FIG. 3).

The first cam 20 and the second cam 30 are pivotally mounted or journaled on the cam shaft 76, and rotatably journaled by the first frame 14 and the second frame 15. Specifically, one end shaft part of the cam shaft 76 is inserted into a shaft hole of the first frame 14 and the other end shaft part of the shaft is inserted into a transmission wheel bearing 75 protruded from the second frame 15.

The first frame 14, the tube frame 16, and the second frame 15 are stacked and closely secured to one another by the securing screw 220 using a securing shaft 212 protruded from the first frame 14.

The finger 44 has a rounded end portion 44*b* in contact with the cam and a flange part 44*c* in the part for pressing the tube 50. The finger is inserted and fixed to a tube guide groove 121 provided on the tube frame 16.

When the drive force (rotational force) from the motor 70 is transmitted to the cam shaft 76, the first cam 20 and the second cam 30 rotate in one direction and press the tube 50 at the finger pressing part 32 against a tube guide wall 122 provided in the first frame 14 for squeezing. When the cams further rotate, they reach an arc part 36 that is a region where they do not press the tube 50, the finger 44 is turned back toward inside by the elastic force of the tube 50, and the tube 50 returns to the tubular shape not being pressed (shown by the chain double-dashed line in the drawing). This movement is repeated and the details will be described with reference to FIG. 5.

Next, a coupling structure of the pump module 11 and the drive module 12 will be described with reference to FIGS. 1 and 2 in addition to FIG. 3. The flange part 141 is provided to be projected to the drive module 12 side on the outer periphery of the first frame 14, and the male thread 142 is formed on the outer periphery of the flange part 141. Further, the flange part 192 projected toward the outside is provided on the outer periphery of the rear cover 19.

While the pump module 11 and the drive module 12 are stacked, the coupling member 13 is inserted from the rear cover 19 side and the pump module 11 and the drive module 12 are screwed for coupling by the coupling member 13. A positioning part is provided on the pump module 11 or drive module 12 especially for accurately controlling the relative position between the cam shaft 76 and the cam drive wheel 74 in the planer direction (which will be described later with reference to FIG. 5).

The flange part 131 projected toward inside and the female thread 132 formed at the inner side of the tube are provided in the coupling member 13. When the coupling member 13 and the pump module 11 are screwed for coupling, the peripheral edge of the flange part 141 of the first frame 14 and the flange part 192 of the rear cover 19 are brought into close contact for securing the waterproof property inside the micropump 10.

The waterproof property is further improved by improving the adhesion by providing a sealing member at or applying a sealing agent to the joining part of the peripheral edge of the flange part 141 and the flange part 192 in close contact. Further, a knurl 133 or concavo-concave shape is formed in the sectional direction on the outer periphery of the coupling member 13 for easy tightening of the screw.

Next, a fitting structure of the cam shaft 76 and the cam drive wheel 74 will be described with reference to the drawings.

Figure 4A:
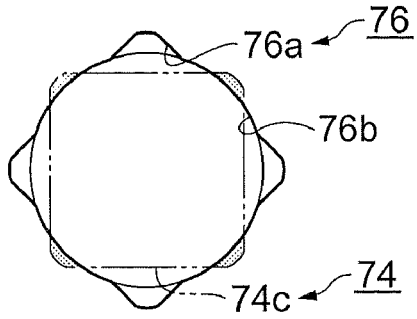
FIGS. 4A to 4C show a fitting structure of a cam shaft and a cam drive wheel according to embodiment 1.
Figure 4B:
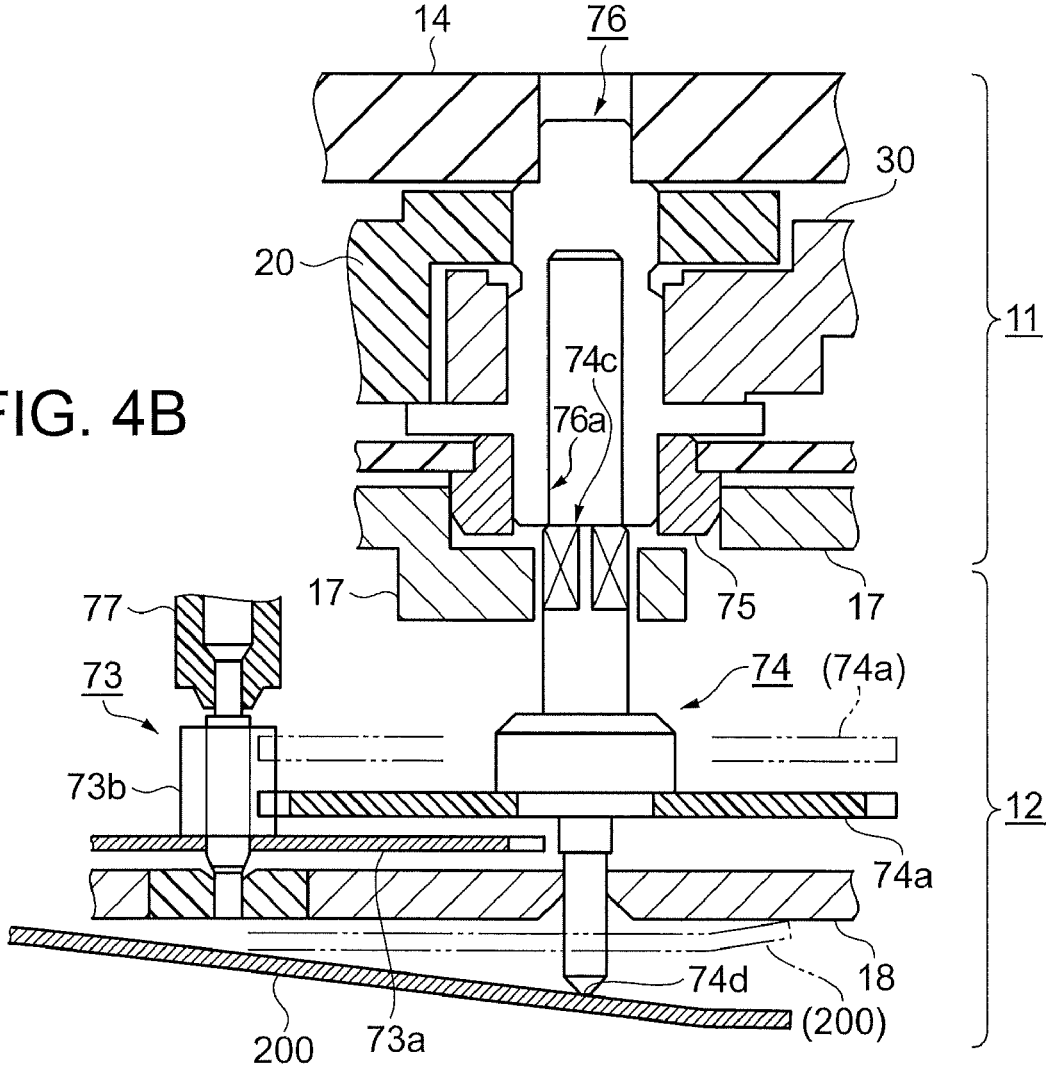
Figure 4C:
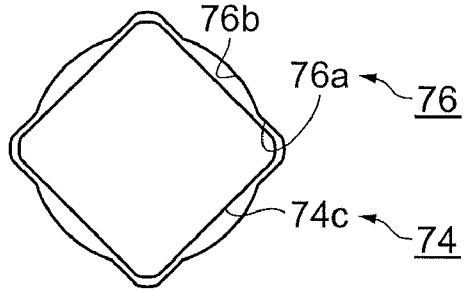

FIGS. 4A to 4C show the fitting structure of the cam shaft 76 and the cam drive wheel 74. FIG. 4A is an explanatory diagram showing an out-of-phase condition, FIG. 4B is a partial sectional view showing a relationship between the cam shaft and the cam drive wheel in the out-of-phase condition, and FIG. 4C is an explanatory diagram showing an in-phase condition. In FIG. 4A, when the pump module 11 and the drive module 12 are coupled, the cam drive wheel fitting hole 76*a* drilled in the cam shaft 76 and the cam drive shaft part 74*c* formed in the cam drive wheel 74 may be out of phase in the rotational direction. In this case, the ends on the four corners of the cam drive shaft part 74*c* and the peripheral edge of the cam drive wheel fitting hole 76*a* are in contact, and the fitting is impossible. The sectional relationship between the cam shaft 76 and the cam drive wheel 74 will be described with reference to FIG. 4B.

The cam drive shaft part 74*c* may be formed by cutting four corners of the outer periphery of a round bar, and the cam drive wheel fitting hole 76*a* may be formed by stamping after a lower hole 76*b* is formed.

In FIG. 4B, when the ends on the four corners of the cam drive shaft part 74*c* and the peripheral edge of the cam drive wheel fitting hole 76*a* are in contact as shown in FIG. 4A, the cam drive wheel 74 is pressed down to the fourth frame 18 side. The cam drive wheel 74 bends the cam drive wheel spring 200 at the end of the support shaft part 74*d*. At the same time, the transmission gear 74*a* of the cam drive wheel 74 moves from the position shown by the chain double-dashed line in the drawing, but remains meshing with the pinion 73*b* of the second transmission wheel 73. Accordingly, under the condition, even when the pump module 11 and the drive module 12 are coupled, the cam shaft 76 and the cam drive wheel 74 are not broken.

Dimensions of the transmission gear 74*a* and the transmission gear 73*a* of the second transmission wheel 73 are set to provide clearance even when the cam drive wheel 74 is pressed down by the cam shaft 76.

Under the condition that the ends on the four corners of the cam drive shaft part 74*c* and the peripheral edge of the cam drive wheel fitting hole 76*a* are in contact, when the motor 70 is driven to rotate the cam drive wheel 74 and the cam drive shaft part 74*c* and the cam drive wheel fitting hole 76*a* are in phase in the rotational direction (the state shown in FIG. 4C), the cam drive wheel 74 is moved toward the cam shaft 76 by the cam drive wheel spring 200 and the cam drive shaft part 74*c* and the cam drive wheel fitting hole 76*a* are fitted.

Simultaneously, the transmission gear 74*a* of the cam drive wheel 74 moves while meshing with the pinion 73*b* of the second transmission wheel 73.

The cam drive shaft part 74*c* and the cam drive wheel fitting hole 76*a* are fitted and coupled, and thus, the drive force from the motor 70 is transmitted from the cam drive wheel 74 to the cam shaft 76 via the drive force transmission mechanism, and the first cam 20 and the second cam 30 press the tube 50 via the finger group.

Figure 5:
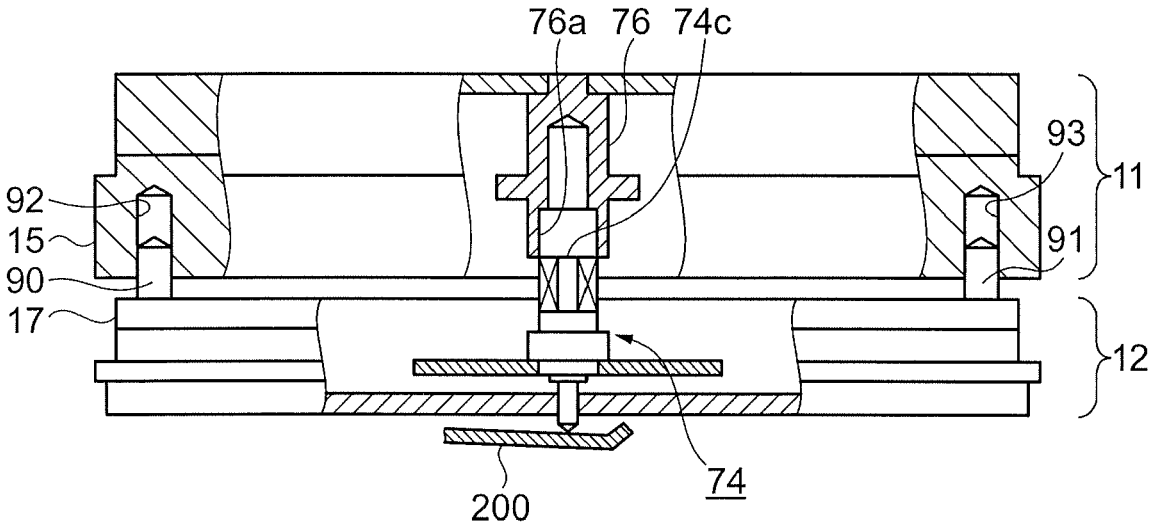
FIG. 5 is a sectional view showing an example of a positioning structure of the pump module and the drive module in a planer direction.

FIG. 5 is a sectional view showing an example of a positioning structure of the pump module and the drive module in the planer direction. In FIG. 5, two guide shafts 90, 91 are protruded from the third frame 17 at the pump module 11 side of the drive module 12. The guide shafts 90, 91 are provided apart substantially at 180° relative to the cam shaft 76.

On the other hand, guide holes 92, 93 are drilled facing the guide shafts 90, 91 in the second frame 15 at the drive module 12 side of the pump module 11. A positioning member includes the guide shafts 90, 91 and the guide holes 92, 93, and the positions of the pump module 11 and the drive module 12 are made the same in the planer direction by inserting the guide shafts 90, 91 into the guide holes 92, 93. In this regard, the positions of the cam drive wheel fitting hole 76*a* provided in the cam shaft 76 and the cam drive shaft part 74*c* provided in the cam drive wheel 74 in the planer direction are accurately controlled.

It is more preferable that the guide holes 92, 93 and the guide shafts 90, 91 are set to start engaging before the cam drive wheel fitting hole 76*a* and the cam drive shaft part 74*c* start to fit each other.

A structure in which the guide holes 92, 93 are provided in the third frame 17 and the guide shafts 90, 91 are provided in the second frame 15 may be adopted.

Subsequently, the planer structure and action of the pump module 11 according to the embodiment will be described with reference to the drawings.

FIG. 6 is a plan view showing a schematic structure of the pump module according to the embodiment. FIG. 6 shows a condition that the micropump 10 is steadily driven. The first frame 14 and the tube frame 16 are omitted. In FIG. 6, the pump module 11 according to the embodiment includes the first cam 20 and the second cam 30 pivotally mounted or journaled on the cam shaft 76 at the center, the tube 50 flowing a fluid, seven fingers 40 to 46 provided radially from the rotational center P of the cam shaft 76 between the tube 50 and the first cam 20 and the second cam 30. The fingers 40 to 46 are radially provided at equal intervals, respectively.

Regarding the first cam 20, the central portion is pivotally mounted on the shaft part of the cam shaft 76, three projecting portions are provided on the outer periphery, and finger pressing parts 21*a* to 21*c* are formed on the outermost periphery. The finger pressing parts 21*a* to 21*c* formed on concentric circles at equal distances from the rotational center P. The finger pressing part 21*a* and the finger pressing part 21*b*, and the finger pressing part 21*b* and the finger pressing part 21*c* are formed with an equal circumferential pitch and an equal outer shape. Further, the distance between the finger pressing part 21*a* and the finger pressing part 21*c* is twice the circumferential pitch of the finger pressing parts 21*a*, 21*b* or the finger pressing parts 21*b*, 21*c*.

A recessed portion formed on a concentric circle with the rotational center P (also the rotational center of the first cam 20 and the second cam 30) of the cam shaft 76 is provided at the base of the finger pressing part 21*a*. The bottom face of the recessed portion is a second cam mounted face 25 on which a spring part 33 of the second cam 30 is mounted, which will be described later. In the above described finger pressing parts 21*a* to 21*c*, finger pressing slopes 22 and arc parts 23 on the concentric circles around the rotational center P are continuously formed. The arc parts 23 are provided in positions where the fingers 40 to 46 are not pressed.

Further, one ends of the finger pressing parts 21*a*, 21*b*, 21*c* and the arc parts 23 are connected by linear portions 24 extended from the rotational center P.

The second cam 30 includes the finger pressing part 32 having the same shape as those of the above described finger pressing parts 21*a*, 21*b*, 21*c* of the first cam 20, and a finger pressing slope 31 having the same shape as those of the finger pressing slopes 22. Further, the spring part 33 projected in a peninsular shape is formed in the second cam 30. The spring part 33 is provided on a concentric circle with the rotational center P and has a shape that can fit into the above described second cam mounted face 25 formed on the first cam 20. A cylindrical friction engaging portion 34 is projected from the rear side of the end of the spring part 33.

In the second cam 30, an arc part 36 having the same diameter as that of the arc part 23 provided in the first cam 20 and a linear portion 35 extended from the rotational center P and connecting the arc part 36 and the finger pressing part 32 are provided on the opposite side to the spring part 33 in the planer direction.

Next, the relationship between the first cam 20 and the second cam 30 will be described. The first cam 20 is pivotally mounted on the shaft part of the cam shaft 76, and rotates in the arrow R direction according to the rotation of the cam shaft 76. The second cam 30 is in a loose fit with the shaft part of the cam drive wheel 74, and does not rotate according to the first cam 20 in the early stage of the driving. However, when a first cam engaging portion 38 at the end of the second cam 30 engages with a second cam engaging portion 26 at the end of the finger pressing part 21*c* of the first cam 20, the rotational force of the first cam 20 is transmitted from the second cam engaging portion 26 to the first cam engaging portion 38, and the second cam 30 rotates with the first cam 20 and becomes capable of pressing the fingers 40 to 46. Such a condition is referred to as the second condition.

Under the second condition, the engagement of the spring part 33 of the second cam 30 and the second cam mounted face 25 of the first cam 20 are released, and it seems that the first cam 20 and the second cam 30 form one cam including the finger pressing parts 21*a* to 21*c*, 32 in four positions.

Though not shown in the drawing, the finger pressing parts 21*a* to 21*c*, 32 are formed on the concentric circle with the rotational center P and set to have dimensions so that adjacent two fingers may be in contact with the finger pressing area formed by the concentric circle.

The tube 50 for flowing a fluid is provided in a position apart from these first cam 20 and second cam 30. The tube 50 has elasticity and is formed of silicon rubber in the embodiment. The tube 50 is placed within the tube guide groove 121 formed in the second frame 15 and the tube frame 16 (see FIG. 3). One end is the outlet 53 from which the fluid is discharged to the outside and projected to the outside of the micropump 10. The other end is the inlet 52 into which the fluid is flows and connected to a connection pipe 55, and the end of the connection pipe communicates with the reservoir containing the liquid (not shown). The communication between the connection pipe 55 and the reservoir may be provided by a tube.

The tube 50 is placed within the tube guide groove 121 formed so that the range pressed by the fingers 40 to 46 may form concentric circles with the rotational center P. The fingers 40 to 46 are radially provided from the rotational center P between the tube 50 and the first cam 20 and second cam 30.

Since the respective fingers 40 to 46 are formed in the same shape, the finger 44 will be described as an example. FIG. 3 is also referred to. The finger 44 includes a cylindrical shaft part 44*a*, a flange part 44*c* provided at one end of the shaft part 44*a*, and an end part 44*b* formed by rounding the other end in a semispherical shape. The flange part 44*c* is a pressing part that presses the tube 50, and the end part 44*b* is a pressed part to be pressed by the first cam 20 and the second cam 30.

The fingers 40 to 46 can reciprocate along a finger guide groove 126, are pressed by the first cam 20 and the second cam 30 outwardly, and presses the tube 50 between the tube guide wall 122 of the tube guide groove 121 and itself to block a fluid flowing part 51 (also see FIG. 3). The central positions of the fingers 40 to 46 in the sectional direction are nearly the same as the center of the tube 50.

Subsequently, the action relating to the fluid transport according to the embodiment will be described with reference to FIG. 6. The state shown in FIG. 6 represents one state in the second condition, and the finger 44 is pressed by the finger pressing part 32 of the second cam 30 and the finger 45 is in contact with the joining part of the finger pressing part 32 and the finger pressing slope 31 and blocks the tube 50. Further, the finger 46 presses the tube 50 on the finger pressing slope 31, but the finger 46 presses less than the finger 44 and does not completely block the tube 50.

The fingers 41 to 43 are located in the range of the arc part 36 of the second cam 30 in the initial positions not for pressing. Further, the finger 40 is in contact with the finger pressing slope 22 of the first cam 20, but does not block the tube 50 in this position.

When the first cam 20 and the second cam 30 are further rotated in the arrow R direction from the position, the fingers 45, 46 sequentially press and block the tube 50 by the finger pressing part 32 of the second cam 30. The finger 44 is released from the finger pressing part 32 and the tube 50 is opened. The fluid flows into the fluid flowing part 51 in the position of the tube 50 where the block is opened or the position that has not yet been blocked by the finger.

When the first cam 20 is further rotated, the finger pressing slope 22 sequentially press the fingers 40, 41, 42, 43 in this order, and reaches the finger pressing part 21*c* to block the tube 50.

By repeating the operation, the fluid is flown from the inlet 52 side toward the outlet 53 side and discharged from the outlet 53.

At this time, two of the fingers are in contact with the respective finger pressing parts of the first cam 20 and the second cam 30. When the cams move to the position for pressing the next finger, one of the fingers are pressed. In this manner, by repeating the state in which two fingers are pressed and the state in which one finger is pressed, a condition in which at least one finger blocks the tube 50 is constantly formed. Thereby, as the first cam 20 and the second cam 30 sequentially press the fingers, even when the pressing of fingers is switched, at least one finger is pressed to block the tube 50. Thus, the back-flow of the fluid can be prevented and the fluid can be continuously flown. The micropump structure of the movement is called a peristaltic drive system.

Next, the first condition immediately before the start of driving of the pump module 11 of the embodiment and the process of transition to the second state as the steady drive state will be described. The graphic representation is omitted. The first condition is also a condition immediately after the micropump 10 is assembled. The first cam 20 and the second cam 30 are assembled so that the spring part 33 of the second cam 30 is provided on the second cam mounted face 25 of the first cam 20.

The spring part 33 of the second cam 30 is mounted on the second cam mounted face 25, and the friction engaging portion 34 projected from the end of the spring part 33 is urged toward the second cam mounted face 25 by the elastic force of the spring part 33 in the vertical direction (thickness direction). By the elastic force, the second cam 30 is held on the first cam 20 and the state is kept until the pump module 11 is driven. The friction engaging portion 34 is provided for keeping the state in the first condition and for reducing the friction resistance when the state changes to the second condition.

In the planar positions of the first cam 20 and the second cam 30 in the first condition, the finger 40 to 46 are provided between the finger pressing part 21*c* of the first cam 20 and the finger pressing part 32 of the second cam 30. Accordingly, the finger 40 is in contact with a part of the finger pressing slope 22 but the finger 40 does not press the tube 50 in this position.

Further, the fingers 41, 42, 43 are in the positions where the first cam 20 or the second cam 30 does not exist and the finger 44, 45, 46 are in the range of the arc part 36 of the second cam 30, and they do not press the tube 50. Therefore, if the pump module 11 is assembled in the first condition and held in the first condition, the fluid flowing part 51 of the tube 50 is kept opened and hardly deformed.

Next, the transition from the above described first condition to the second condition will be described. The first cam 20 and the second cam 30 rotate in the arrow R direction remaining in the first condition. Concurrently, the finger pressing parts 21*c*, 21*b*, 21*a* of the first cam 20 sequentially press the fingers 40 to 46 and flow the fluid.

When the finger pressing slope 31 of the second cam 30 reaches to the position in contact with the finger 40, the transition to the second condition starts. When the finger pressing slope 31 reaches the finger 40 and the first cam 20 further rotates in the arrow R direction, the finger pressing slope 31 gradually presses the finger 40 and the finger 40 starts to press the tube 50. Then, the friction resistance between the finger pressing part 32 and the finger 40 increases.

Since the second cam 30 is in the loose fit with the cam shaft 76 and the relative position relationship between the first cam 20 and itself is held only by the friction resistance between the spring part 33 and the second cam mounted face 25, the second cam 30 starts to rotate in the opposite direction relative to the first cam 20 at the time when the friction resistance between the finger pressing slope 31 and the finger 40 becomes larger than the friction resistance between the spring part 33 and the second cam mounted face 25. Then, the state transits to the second condition as shown in FIG. 6.

Further, a detection device for detecting that the pump module 11 and the drive module 12 are coupled in a predetermined state is provided between the pump module 11 and the drive module 12. As the detection device, for example, contact detection type, photodetection type, or the like may be adopted, the contact detection type will be described as an example in the embodiment.

FIGS. 7A and 7B show an example of the detection device, and FIG. 7A is a partial sectional view and FIG. 7B is a plan view showing a second detection terminal of the detection device. In 7A and 7B, the detection device includes a detection shaft 240 as a first detection terminal and the second detection terminal 250. FIG. 7A shows a state in which the pump module 11 and the drive module 12 are properly coupled (the pump module 11 and the drive module 12 are in close contact on the joining faces with each other). The detection shaft 240 is a shaft member having conductivity, and protruded from the first frame 14 through the tube frame 16 and the second frame 15. One end 240*a* of the detection shaft 240 is projected from the upper face of the first frame 14. Further, the other end 240*b* is partially projected from the third frame 17 of the drive module 12.

The end 240*b* of the detection shaft 240 urges in contact with a terminal part 250*b* of the second detection terminal 250 provided in the third frame 17. The amount of urging (the amount of bending) of the terminal part 250*b* by the detection shaft 240 is set in a range where the contact pressure between the end 240*b* and the terminal part 250*b* can be secured when the pump module 11 (the second frame 15) contacts the drive module 12 (the third frame 17).

The second detection terminal 250 is formed of a material having conductivity and includes an annual holding part 250*a* and the inwardly projected terminal part 250*b*. The terminal part 250*b* has elasticity and urges the detection shaft 240 at predetermined contact pressure. The second detection terminal 250 is fixed at the holding part 250*a* to the upper step of two-step recessed portion 17*a* provided in the third frame 17 using a conductive adhesive or the like (see FIG. 7A). Accordingly, the terminal part 250*b* is a free end.

When the pump module 11 and the drive module 12 are coupled in the proper range, the detection shaft 240 and the second detection terminal 250 are brought into contact and electrically conducted. The conductive state is detected by a detector such as a tester or the like (not shown).

When the pump module 11 and the drive module 12 are not coupled in the proper range, the detection shaft 240 and the second detection terminal 250 are apart and do not electrically conductive. The state may be detected by the detector.

According to the above described embodiment 1, the micropump 10 is formed by stacking and detachably coupling the pump module 11 and the drive module 12 with the coupling member 13. Therefore, the pump module 11 including the tube 50 that directly contact the fluid such as a chemical solution can be made detachable from the drive module 12 and disposable in consideration of durability of the tube 50 and the drive module in no contact with the chemical solution can be used repeatedly. The pump module 11 has the minimum configuration including the tube 50, the cams (the first cam 20 and the second cam 30), and the cam shaft 76, and therefore, the running cost can be reduced.

Further, when the pump module 11 and the drive module 12 are coupled, if the cam drive wheel fitting hole 76*a* of the cam shaft 76 and the cam drive shaft part 74*c* of the cam drive wheel 74 are out of phase, the cam drive wheel spring 200 is bent for moving away the cam drive wheel 74, and therefore, the load urged on the cam shaft 76 and the cam drive wheel 74 is the elastic force of the cam drive wheel spring 200 alone and they are hardly broken.

Furthermore, when the cam drive wheel 74 is rotated by the motor 70 and the cam drive wheel fitting hole 76*a* and the cam drive shaft part 74*c* of the cam drive wheel 74 are in phase in the rotational direction, the cam drive wheel 74 moves toward the cam shaft 76 due to the urging force of the cam drive wheel spring 200 and fitted and coupled, and thereby, the drive force from the motor 70 can be transmitted to the cam shaft 76. That is, the fluid can be transported by the rotation of the cams. In the related art, it is necessary to assemble with the pinion and the gear in phase, however, in the embodiment, it is not necessary to assemble the cam shaft 76 and the cam drive wheel 74 in phase with each other, and the ease of assembly can be improved. Further, there is an advantage that the cam shaft 76 and the cam drive wheel 74 are hardly broken when assembled (coupled).

Moreover, in the embodiment, since the motor 70 as the drive source is provided in the drive module 12, the coupling (mesh-coupling) between the motor 70 and the cam drive wheel 74 can be made in the same manner as that in a general gear train.

Further, since the detection device for detecting that the pump module 11 and the drive module 12 are coupled in a predetermined state is provided, the proper coupling state between the pump module 11 and the drive module 12 can be detected and the micropump 10 can be used at ease.

Furthermore, the cam drive wheel spring 200 urging the cam drive wheel 74 is in contact with the fourth frame 18 at the end 200*a* when the cam drive wheel fitting hole 76*a* and the cam drive shaft part 74*c* are properly fitted. Therefore, the contact load in the shaft direction between the cam drive wheel 74 and the camshaft 76 can be suppressed in an appropriate range at the time of driving, and the stability and reliability of driving can be improved.

In the embodiment, the positioning member that makes the positions of the pump module 11 and the drive module 12 in the planar direction the same is provided. The positioning member controls the positions of the pump module and the drive module in the planar direction before the linkage mechanism starts fitting. Thereby, the accurate positions of the cam drive wheel fitting hole 76*a* and the cam drive shaft part 74*c* of the linkage mechanism are also controlled and the coupling between the pump module and the drive module can be ensured.

In the above described embodiment 1, the structure in which the cam drive wheel 74 is movable in the shaft direction has been taken as an example, a structure of moving the cam shaft 76 may be adopted. Specifically, the structure can be realized by providing an elastic member at the upper side of the cam shaft 76 to allow the cam shaft 76 with the first cam 20 and the second cam 30 to move in the shaft direction and control the movement of the cam drive wheel 74 in the shaft direction.

Embodiment 2

Subsequently, a micropump according to embodiment 2 will be described with reference to the drawings. The embodiment 2 is characterized in that the motor 70 is provided in the pump module 11 while the motor 70 is provided in the drive module 12 in the above described embodiment 1. Accordingly, the embodiment 2 will be explained by centering the different points from those of embodiment 1. In the embodiment, the fitting and coupling structure of the cam shaft 76 and the cam drive wheel 74 is also used, but the illustration and description are omitted because the structure is the same as the structure in the above described embodiment 1.

FIGS. 8, 9 are partial sectional views showing the micropump according to the embodiment 2. FIG. 8 shows a state in which the pump module 11 and the drive module 12 are coupled and drivable. In FIG. 8, the motor 70 as a drive source is mounted within a recessed part 15*a* provided in the second frame 15 of the pump module 11.

The motor 70 is fixed by press-fitting motor guide shafts 70*b* into the second frame 15 for accurately controlling the accurate relative position of the motor transmission wheel 71 and a motor drive shaft 70*a*, and the cam shaft 76 and the cam drive wheel 74 (see FIG. 3) in the planer direction. The motor drive shaft 70*a* is formed to have a sectional shape of square, and the sectional shape drilled in the motor transmission wheel 71 is inserted and fitted into a motor shaft fitting hole 71*c* having a sectional shape of square.

The motor transmission wheel 71 includes a gear part 71*a* and a support shaft 71*b*, and an end part 71*d* is urged toward the motor 70 by a motor transmission wheel spring 210 as a second elastic member. In this state, the gear part 71*a* of the motor transmission wheel 71 and the transmission gear 72*a* of the first transmission wheel 72 are meshed and coupled. Accordingly, the drive force of the motor 70 is transmitted to the pump module 11 via the first transmission wheel 72.

The motor 70 is connected to a motor substrate 230 by four connecting terminals 80. The motor substrate 230 is provided at the pump module 11 side, and connected to the circuit substrate including the control circuit, the memory, and the power supply control circuit provided at the drive module 12 side using a contact pin etc. (not shown).

FIG. 9 is a partial sectional view showing a relationship between the motor 70 and the motor transmission wheel 71 when the motor drive shaft 70*a* and the motor shaft fitting hole 71*c* are out of phase in the rotational direction. In the state in FIG. 8, four corner ends of the motor drive shaft 70*a* and the peripheral edge of the motor shaft fitting hole 71*c* are in contact. Simultaneously, the motor transmission wheel 71 is pressed down toward the fourth frame 18. Then, the motor transmission wheel 71 bends the motor transmission wheel spring 210 at the end part 71*d*. The gear part 71*a* of the motor transmission wheel 71 remain meshing with the transmission gear 72*a* of the first transmission wheel 72. Accordingly, even if the pump module 11 and the drive module 12 are coupled in the state, the motor drive shaft 70*a* and the motor transmission wheel 71 are hardly broken.

In the case where the motor 70 is driven in the state shown in FIG. 9, when the motor drive shaft 70*a* and the motor shaft fitting hole 71*c* are in phase in the rotational direction, the motor transmission wheel 71 is moved toward the motor 70 by the motor transmission wheel spring 210 and the motor drive shaft 70*a* and the motor shaft fitting hole 71*c* are fit and coupled. At the same time, the gear part 71*a* of the motor transmission wheel 71 is moved while meshing with the transmission gear 72*a* of the first transmission wheel 72, and the drive force can be transmitted as shown in FIG. 8.

When the motor transmission wheel 71 is attached to the first frame 14, the position of the motor transmission wheel 71 can be stably held until the pump module 11 is coupled by guiding the periphery of the motor transmission wheel 71 by the fourth frame 18 or another guide member.

When the micropump 10 is attached to or within a living body, an extremely small motor is used. A step motor for watch is used in the related art. Accordingly, the dimensions of component elements of the motor 70 are very small, and it is predicted that the durability may not be secured due to the load when the pump module 11 is driven. In this case, the pump module 11 can be replaced including the motor 70 at the time of replacement of the pump module 11.

Therefore, there is another advantage that the workability is improved because it is not necessary to detach the motor 70 from the pump module 11 at the replacement of the pump module 11.

Embodiment 3

Subsequently, embodiment 3 will be described with reference to the drawings. The embodiment 3 is another example of linkage mechanism, and characterized in that the linkage mechanism has projections on the end of one of the pump module 11 and the drive module 12 and depressions on the end of the other one of them and the ends are opposed, and the projections and depressions are engaged to link the drive force transmission mechanism between the motor and cam shaft. Accordingly, the linkage mechanism is centered for explanation.

FIGS. 10A to 10C show linkage mechanisms according to embodiment 3. FIG. 10A is a partial sectional view showing a linkage between the cam shaft and the cam drive wheel and FIG. 10B is a partial sectional view showing a linkage between the motor drive shaft and the motor transmission wheel.

Further, FIG. 10A is another example of the embodiment 1 (see FIGS. 4A to 4C), and a crown gear 76*c* is provided on the end face of the cam shaft 76 and a crown gear 74*e* is provided on the end face of the cam drive wheel 74 opposed to the crown gear 76*c*. The crown gears 76*c* and 74*e* have teeth of the same pitch. FIG. 10A shows a state in which the cam shaft 76 and the cam drive wheel 74 are out of phase in the rotational direction, and the tooth ends of the crown gears 76*c* and 74*e* are in contact. When the cam drive wheel 74 is rotated from the state, the crown gear 76*c* and the crown gear 74*e* are in phase and meshed, the cam drive wheel 74 and the cam shaft 76 are linked, and the drive force from the motor can be transmitted to the cam.

FIG. 10B is another example of the embodiment 2 (see FIGS. 8, 9), and a crown gear 70*c* is provided on the end face of the motor drive shaft 70*a* and a crown gear 71*e* is provided on the end face of the motor transmission wheel 71 opposed to the crown gear 70*c*. The crown gears 70*c* and 71*e* have teeth of the same pitch. FIG. 10B shows a state in which the motor drive shaft 70*a* and the motor transmission wheel 71 are out of phase in the rotational direction, and the tooth ends of the crown gear 70*c* and the tooth ends of the crown gear 71*e* are in contact. When the motor drive shaft 70*a* is rotated from the state, the crown gear 70*c* and the crown gear 71*e* are in phase and meshed, the motor drive shaft 70*a* and the motor transmission wheel 71 are linked, and the drive force from the motor 70 can be transmitted to the cam.

FIG. 10C is a partial sectional view showing yet another example. Coupling of the cam shaft and the cam drive wheel is taken as an example and described. Grooves 76*d*, 76*e* as depressions are provided on the outer circumference at the end of the cam shaft 76. On the other hand, guide shafts 74*f*, 74*g* as projections are projected on the end surface of the cam drive wheel 74 opposed to the cam shaft 76. FIG. 10C shows a state in which the cam shaft 76 and the cam drive wheel 74 are out of phase in the rotational direction, and the cam shaft 76 of the cam drive wheel 74 and the opposed end surfaces of them are in contact. When the cam drive wheel 74 is rotated from the state, the grooves 76*d*, 76*e* and the guide shafts 74*f*, 74*g* are in phase and fitted (engaged), the cam drive wheel 74 and the cam shaft 76 are linked, and the drive force from the motor can be transmitted to the cam.

According to the above described other examples, given that the number of teeth of the crown gears 76*c* and 74*e* (or the crown gears 70*c* and 71*e*) is n, they may be rotated 1/n revolution for meshing with each other, and they can be meshed and linked promptly.

Further, when the linkage mechanism is formed by the grooves 76*d*, 76*e* and the guide shafts 74*f*, 74*g*, there are advantages that the structure can be simplified and the mechanism can be manufactured without using a special working machine such as a tooth forming machine.

In the linkage mechanism, the number of grooves and guide shafts is not limited but three or more pairs may be provided, or plural holes may be provided in place of the grooves.

Embodiment 4

Subsequently, a micropump according to embodiment 4 will be described with reference to the drawings. The embodiment 4 is characterized in that a structure of meshing and coupling the motor transmission wheel 71 and the first transmission wheel 72 is adopted while the fitting and coupling structure of the motor drive shaft 70*a* and the motor transmission wheel 71 is adopted in the above described embodiment 2. Accordingly, the rest of the structure is the same as that in embodiment 1, and illustration and description thereof will be omitted.

FIG. 11 is a partial sectional view showing a structure of the micropump according to the embodiment 4. In FIG. 11, the motor 70 as a drive source is mounted within a recessed part 15*a* provided in the second frame 15 of the pump module 11. Further, the motor transmission wheel 71 is pivotally mounted on the motor drive shaft 70*a* of the motor 70.

The motor 70 is fixed by press-fitting motor guide shafts 70*b* into the second frame 15 for accurately controlling the accurate relative positions of the drive transmission mechanism and itself in the planer direction.

The first transmission wheel 72 includes a transmission gear 72*a* and a pinion 72*b* and journaled movably in the shaft direction between the third frame 17 and the fourth frame 18. Further, the end of a support shaft 72*c* is urged toward the third frame 17 side by a first transmission wheel spring 215 as a third elastic member. FIG. 11 shows a state in which the pump module 11 and the drive module 12 are properly coupled, the motor transmission wheel 71 and the transmission gear 72*a* of the first transmission wheel 72 and the pinion 72*b* of the first transmission wheel 72, and the transmission gear 73*a* of the second transmission wheel 73 are meshed with each other, and the drive force from the motor 70 is transmitted to the cam shaft 76.

Next, the relationship between the motor transmission wheel 71 and the first transmission wheel 72 when the pump module 11 and the drive module 12 are coupled will be explained. When the pump module 11 and the drive module 12 are coupled, sometimes the motor transmission wheel 71 and the transmission gear 72*a* of the first transmission wheel 72 are out of phase in the rotational direction. In such a condition, the end part 71*d* of the motor transmission wheel 71 and an upper face 72*d* of the transmission gear 72*a* are overlapped at the teeth, the first transmission wheel 72 bends the first transmission wheel spring 215, and the spring is moved away from the motor transmission wheel 71 (i.e., the motor 70) in the shaft direction (shown by the chain double-dashed line).

Under the condition, when the motor 70 is driven to rotate the motor transmission wheel 71 and the teeth of the motor transmission wheel 71 and the transmission gear 72*a* are in phase, the first transmission wheel 72 is pressed up because the first transmission wheel 72 is urged by the first transmission wheel spring 215, and the motor transmission wheel 71 and the transmission gear 72*a* are meshed and coupled.

In the above described range of movement in the shaft direction, dimensions of the support shaft of the first transmission wheel 72 are set so that the third frame 17 and the fourth frame 18 may remain fitted. Further, the dimensions of the transmission gear 72*a* are set so that the transmission gear 72*a* of the first transmission wheel 72 and the transmission gear 73*a* of the second transmission wheel 73 remain meshed in the sectional direction.

Therefore, according to embodiment 4, the pump module 11 can be replaced including the motor 70 at the time of replacement of the pump module as is the case of the above described embodiment 2.

Further, when the pump module 11 and the drive module 12 are coupled, if the teeth of the motor transmission wheel 71 and the transmission gear 72*a* of the first transmission wheel 72 are out of phase in the rotational direction, the motor transmission wheel 71 and the transmission gear 72*a* are overlapped, but they are not broken because the urging force of the first transmission wheel spring 215 is applied to the motor transmission wheel 71 and the first transmission wheel 72 only in the shaft direction.

Furthermore, when the motor transmission wheel 71 rotates due to the drive force of the motor 70 and the teeth of the motor transmission wheel 71 and the transmission gear 72*a* of the first transmission wheel 72 are in phase, the first transmission wheel 72 is urged by the first transmission wheel spring 215, moves toward the motor transmission wheel 71, and is meshed with and coupled thereto. Thereby, the drive force from the motor 70 is transmitted to the cam shaft 76 for driving the first cam 20 and the second cam 30.

Therefore, it is necessary to assemble the pinion and gear in phase in the related art, however, in the application example, it is not necessary to assemble with the teeth of the motor transmission wheel 71 and the transmission gear 72*a* of the first transmission wheel 72 in phase, but they are meshed with and linked to each other by driving the motor 70, and the ease of assembly can be improved.

The cam shaft 76 contained in the pump module 11 and the cam drive wheel 74 contained in the drive module 12 may be coupled in the same manner as in the above described embodiment 1, which provides the same advantage.

Embodiment 5

Subsequently, embodiment 5 will be described with reference to the drawings. The embodiment 5 is another example of detection device, and characterized in that the cam drive wheel spring 200 described in embodiment 1 (see FIG. 3), the motor transmission wheel spring 210 described in embodiment 2 (see FIG. 8), or the first transmission wheel spring 215 described in embodiment 3 (see FIG. 11) is also served as a second detection terminal.

FIG. 12 is a partial sectional view showing the detection device according to embodiment 5. FIG. 12 shows the case where the cam drive wheel spring 200 is used as the second detection terminal as an example. Electrode patterns 95, 96 are provided on the surface of the fourth frame 18. The respective electrode patterns 95, 96 are electrically independent. One of the electrode patterns 95, 96 is connected to a detection circuit (not shown) and the other is connected to GND.

The shape and the mounting structure of the cam drive wheel spring 200 are the same as in embodiment 1 (see FIG. 3), and the tail is connected and secured onto the electrode pattern 96 by the securing screw 220. On the other hand, the leading end 200*a* is apart from the electrode pattern 95 (shown by the solid line) when the cam shaft 76 and the cam drive wheel 74 are out of phase in the rotational direction. When the cam shaft 76 and the cam drive wheel 74 are in phase in the rotational direction, that is, the pump module 11 and the drive module 12 are coupled in the predetermined state, the leading end 200*a* is connected to the electrode pattern 95 corresponding to the detection shaft 240 (see FIG. 7A). Accordingly, the condition that the pump module 11 and the drive module 12 are coupled in the predetermined state can be detected.

The motor transmission wheel spring 210 in embodiment 2 and the first transmission wheel spring 215 in embodiment 4 may be used in the similar structures as the second detection terminal. In the configuration of embodiment 2, one or both of the cam drive wheel spring 200 and the motor transmission wheel spring 210 may be used as the second detection terminal. Further, in the configuration of embodiment 4, one or both of the cam drive wheel spring 200 and the first transmission wheel spring 215 may be used as the second detection terminal.

According to the configuration, since the cam drive wheel spring 200, the motor transmission wheel spring 210, or the first transmission wheel spring 215 is also served as the second detection terminal, there is no need to provide any detection terminal exclusively for detection, and the structure can be simplified. Further, the space for providing the detection device is no longer necessary, which contributes to downsizing.

Embodiment 6

Subsequently, a micropump according to embodiment 6 will be described with reference to the drawings. The embodiment 6 is characterized in that the coupling member 13 has a bayonet structure while the coupling member 13 in the above described embodiment 1 is screwed for coupling with a coupling member having a nut-like shape. Accordingly, a coupling structure will be explained.

FIG. 13 is a partial sectional view showing the coupling structure according to embodiment 6, FIGS. 14A and 14B are explanatory diagrams showing a coupling method. In FIG. 13, a third frame fixing part 150*a* of a fixing ring 150 having a ring shape is press-fitted to the outer periphery of the third frame 17 at the drive module 12 side for integration of the third frame 17 and the fixing ring 150. Further, a fixing part 14*a* projected in a ring shape to the drive module 12 side is provided on the outer periphery of the first frame 14 at the pump module 11 side.

A coupling member support part 143 having a flange shape projected in the outer circumferential direction is provided on the fixing part 14*a*, and a coupling member fixing groove 144 is formed below.

The coupling member 13 generally has a ring shape. A gasket holding groove 134 is provided on the upper end and a gasket holding groove 135 is provided on the lower end, and gaskets 160, 161 as seal members and elastic members are placed in the respective grooves. Further, a rear cover fixing part 138 is projected from the lower most outer periphery of the coupling member 13.

A pump module fixing flange 136 inwardly projected and a drive module fixing flange 137 are provided on the coupling member 13, and a step-like coupling member pressing part 150*b* provided on the fixing ring 150 is pressed up toward the pump module 11 by the drive module fixing flange 137, and the pump module fixing flange 136 is held within the coupling member fixing groove 144.

The pump module fixing flange 136 presses a flange upper face 145*a* of a coupling member fixing flange 145 by the elastic force of the gasket 160. At the same time, the pump module 11 and the drive module 12 are pressed in the direction in pressure contact between the coupling member fixing flange 145 and the drive module fixing flange 137, and closely coupled at the joining faces of them.

Further, the rear cover 19 is secured with a securing screw (not shown) on the rear cover fixing part 138 provided at the lowermost part of the coupling member 13. The gasket 161 is provided between the coupling member 13 and the rear cover 19, and keeps a fluid from entering into the micropump 10 together with the gasket 160 provided between the coupling member 13 and the first frame 14.

The pump module 11 and the drive module 12 may be coupled after the rear cover 19 is secured to the coupling member 13, or the rear cover 19 is attached to the coupling member 13 after the pump module 11 and the drive module 12 may be coupled.

Referring to FIGS. 14A and 14B, a coupling method of the pump module 11 and the drive module 12 will be described. FIG. 14A is a perspective view of the pump module and FIG. 14B is a perspective view showing a part of the coupling member. In the fixing part 14*a* of the first frame 14, the coupling member fixing groove 144 provided along the outer circumferential direction and a coupling member insertion groove 146 from the end of the fixing part 14*a* communicating nearly vertically with the coupling member fixing groove 144 are formed.

The pump module fixing flange 136 projected toward inside of the coupling member 13 is inserted from the coupling member insertion groove 146 and rotated along the coupling member fixing groove 144, and thereby, the pump module 11 and the drive module 12 may be coupled as shown in FIG. 9.

A pair of the coupling member fixing groove 144 and the coupling member insertion groove 146 provided in the first frame 14 are provided in positions of the fixing part 14*a* opposed to each other and a pair of the pump module fixing flanges 136 of the coupling member 13 are also provided in opposed positions, and thereby, pressure contact forces are balanced in coupling. Accordingly, not limited to one pair but two pairs of flanges, grooves, etc. relating to coupling may be provided, or three of them may be provided at equal intervals in the circumferential direction. Such a coupling structure is referred to as a bayonet structure.

Therefore, according to the above described embodiment 4, the pump module fixing flange 136 of the coupling member 13 is inserted into the coupling member insertion groove 146 of the first frame 14 and rotated along the coupling member fixing groove 144, and thereby, the pump module 11 and the drive module 12 can be easily coupled.

Further, when the pump module 11 is detached from the drive module 12, the opposite operation to the mounting operation may be performed. Specifically, the pump module 11 can be easily detached from the drive module 12 by rotating the coupling member 13 along the coupling member fixing groove 144 in the opposite direction to the position of the coupling member insertion groove 146.

The same bayonet structure may be adopted in the structure in which the motor 70 in the above described embodiment 2 is provided at the pump module 11 side.

Further, a structure in which the coupling member 13 is attached from the pump module 11 side to the drive module 12 side may be adopted. In this case, the rear cover 19 may be secured to the coupling member 13 after coupling.

The invention is limited to the above described embodiments, but modifications, improvements, etc. within the range in which the advantages of the invention can be realized are included in the invention.

Since the micropumps 10 according to the above described embodiment 1 to embodiment 6 can be downsized and stably and continuously flow a slight amount of flow, they are preferable for medical use in attachment within a living body and development of new drugs. In various kinds of machine equipment, the micropump may be attached inside or outside of the equipment for transport use of saline solution, chemical solution, oils, aromatic solution, ink, gas, etc. Further, the micropump may be singly used for flow or supply of the fluid.

The entire disclosure of Japanese Patent Application Nos: 2007-148982, filed Jun. 5, 2007 and 2008-026012, filed Feb. 6, 2008 are expressly incorporated by reference herein.

What is claimed is:

1. A micropump for a peristaltic drive system for pressing a tube having elasticity to transport a fluid, the micropump comprising:

a pump module including the tube, a cam that presses the tube, and a cam shaft on which the cam is pivotally mounted;

a drive module including a drive force transmission mechanism that has a transmission wheel including a pinion and a first transmission gear, and a cam drive wheel including a drive shaft and a second transmission gear, and that transmits a drive force from a motor to the cam shaft through the transmission wheel and the cam drive wheel, the drive module being provided below the pump module; and a coupling member that detachably couples the pump module and the drive module, the coupling member being provided alongside the pump module and the drive module, wherein the cam shaft has a first fitting portion in a first non-circular shape, the cam drive wheel is detachable from the cam shaft, the drive force is transmitted from the pinion to the drive shaft through the second transmission gear, and the drive shaft has a second fitting portion in a second non-circular shape, the first non-circular shape has a first plurality of curved angles, the second non-circular shape has a second plurality of curved angles, the first and second fitting portions are press fit into place by pressure from an elastic member when the first and second plurality of curved angles are aligned with each other through rotating the cam drive wheel by the motor, and when the first and second fitting portion are press fit into place by the pressure from the elastic member, an edge of the second transmission gear slides downward along the pinion and stops without contacting the first transmission gear so that dimensions of the first and second transmission gears are set to provide clearance.

2. The micropump according to claim 1, wherein the drive module includes the motor, the pump module and the drive module in substantially disk shapes, and the coupling member is provided circumferentially around the pump module and the drive module, the coupling member having a ring shape.

3. The micropump according to claim 2, wherein, in the case where the pump module and the drive module are coupled, when the first and second fitting portions are out of phase in a rotational direction, ends of the first and second fitting portions are in contact with each other, and when the cam drive wheel rotates so that the first and second fitting portions are in phase in the rotational direction, the first and second fitting portions are press fit into place by the elastic member, and the cam shaft and the cam drive wheel are linked so that an internal surface of one of the first and second fitting portions contacts with an outer surface of another of the first and second fitting portions.

4. The micropump according to claim 1, wherein the pump module includes the motor having a motor drive shaft that is in a third non-circular shape, the drive force transmission mechanism includes a motor transmission wheel having a motor shaft fitting hole that is in a fourth non-circular shape, and the motor drive shaft and the motor shaft fitting hole are press fit into place by pressure from a second elastic member when the first non-circular shape and the second non-circular shape are aligned with each other through rotating the motor drive shaft.

5. The micropump according to claim 1, wherein the pump module includes the motor on which a motor transmission wheel is pivotally mounted, the drive module includes a second transmission wheel, and the second transmission wheel is urged to mesh with the motor transmission wheel by another elastic member.

6. The micropump according to claim 5, wherein, in the case where the pump module and the drive module are coupled, when a gear part of the motor transmission wheel and a third transmission gear of the second transmission wheel are out of phase in a rotational direction, the gear part and the third transmission gear are overlapped, and the gear part and the third transmission gear are aligned through rotating the motor transmission wheel, the gear part and the third transmission gear are press fit into place by pressure from the third elastic member.

7. The micropump according to claim 1, further comprising at least two projections on one end and at least two depressions on another end, the ends opposed to each other between the pump module and the drive module, and when the pump module and the drive module are coupled, the projections and the depressions are engaged and the drive force transmission mechanism is linked between the motor and the cam shaft.

8. The micropump according to claim 7, wherein the projections and the depressions are formed of crown gears, respectively.

9. The micropump according to claim 1, wherein the coupling member has a flange part that presses a flange part provided on an outer periphery of the drive module and a thread screwed in an outer periphery of the pump module, and the pump module and the drive module are screwed and coupled by the coupling member.

10. The micropump according to claim 1, wherein the drive module has a coupling member pressing part provided on the outer periphery thereof, the pump module has a coupling member fixing groove provided on the outer periphery thereof in a circumferential direction and a coupling member insertion groove that nearly vertically communicates with the coupling member fixing groove, the coupling member includes a drive module fixing flange that pressing the coupling member pressing part and a pump module fixing flange inwardly projected, and the pump module fixing flange is inserted into the coupling member insertion groove, and then, the pump module and the drive module coupled by rotating the coupling member along the coupling member fixing groove.

11. The micropump according to claim 1, further comprising a detection device that detects that the pump module and the drive module are coupled to each other in a predetermined position.

12. The micropump according to claim 11, wherein the detection device has a first detection terminal provided in one of the pump module and the drive module and a second detection terminal provided in the other one and having elasticity, and when connection between the first detection terminal and the second detection terminal is detected, driving of the motor is continued.

13. The micropump according to claim 12, wherein the second detection terminal is one of the first elastic member, a second elastic member, and a third elastic member.

14. The micropump according to claim 11, wherein, after the motor is driven, if the detection device does not detect coupling of the pump module and the drive module when the cam drive wheel rotate at least one revolution, driving of the motor is stopped.

15. The micropump according to claim 1, wherein a positioning member that makes positions of the pump module and the drive module in a planar direction that is the same before the drive force transmission mechanism is linked between the motor and the cam shaft is provided in either the pump module or the drive module.

16. The micropump according to claim 1, wherein the first and second non-circular shapes are substantially square shapes, and sizes of the first and second non-circular shapes are different from each other for fitting the first fitting portion with the second fitting portion.

* * * * *